US005655181A

United States Patent [19]

Chadani et al.

[11] Patent Number: 5,655,181

[45] Date of Patent: Aug. 5, 1997

[54] TONER ACCOMMODATION CONTAINER, PROCESS CARTRIDGE AND ELECTROPHOTOGRAPHIC IMAGE FORMING APPARATUS

[75] Inventors: Kazuo Chadani, Kawasaki; Tadayuki Tsuda, Hachioji; Kazunori Kobayashi, Kawasaki, all of Japan

[73] Assignee: Canon Kabushiki Kaisha, Tokyo, Japan

[21] Appl. No.: 624,254

[22] Filed: Mar. 29, 1996

[30] Foreign Application Priority Data

Apr. 3, 1995 [JP] Japan ..... 7-103140

[51] Int. Cl.[6] ..... G03G 15/08

[52] U.S. Cl. ..... 399/114; 399/262; 222/DIG. 1

[58] Field of Search ..... 355/210, 260; 222/DIG. 1; 141/363, 764

[56] References Cited

U.S. PATENT DOCUMENTS

| | | | |
|---|---|---|---|
| 4,942,432 | 7/1990 | Mort et al. | 355/260 |
| 5,034,776 | 7/1991 | Sugiura | 355/260 |
| 5,175,070 | 12/1992 | Tanikawa et al. | 430/122 |
| 5,202,731 | 4/1993 | Tanikawa et al. | 355/251 |
| 5,294,960 | 3/1994 | Nomura et al. | 355/210 |
| 5,419,468 | 5/1995 | Taki | 355/260 X |

FOREIGN PATENT DOCUMENTS

| | | |
|---|---|---|
| 0106569 | 4/1984 | European Pat. Off. . |
| 0488184 | 6/1992 | European Pat. Off. . |
| 0581199 | 2/1994 | European Pat. Off. . |
| 0586044 | 3/1994 | European Pat. Off. . |
| 0717326 | 6/1996 | European Pat. Off. . |
| 3641077 | 6/1988 | Germany . |
| 56-087068 | 7/1981 | Japan . |
| 59-168469 | 9/1984 | Japan . |
| 2-186375 | 7/1990 | Japan . |

OTHER PUBLICATIONS

Patent Abstracts of Japan vol. 5, No. 154 (P–82) [826] Sep. 29, 1981 (56–87068).

Patent Abstracts of Japan vol. 9, No. 24 (P–331) [1747] Jan. 31, 1985 (59–168469).

*Primary Examiner*—Joan H. Pendegrass

*Attorney, Agent, or Firm*—Fitzpatrick, Cella, Harper & Scinto

[57] ABSTRACT

A toner accommodation container for containing toner to be used for developing a latent image formed on a electrophotographic photosensitive member, wherein the toner accommodation container is supplied with toner from a toner supply container includes a toner accommodating portion for accommodating the toner; a toner supply opening for supplying toner; a cover member for covering the toner supply opening, wherein the cover member is movable between a closing portion for covering the toner supply opening and an open position for permitting supply of the toner therethrough; a blocking member, provided inside the covering member, for preventing the toner from scattering from the toner accommodating portion to outside, the blocking member is locked by a first locking member and a second locking member; wherein the blocking member is movable to the open position by the first locking member being released by the toner supply container and the second locking member being released by the cover member.

30 Claims, 31 Drawing Sheets

TONER ACCOMMODATION CONTAINER, PROCESS CARTRIDGE AND ELECTROPHOTOGRAPHIC IMAGE FORMING APPARATUS

FIELD OF THE INVENTION AND RELATED ART

The present invention relates to a toner accommodation container, a process cartridge and an electrophotographic image forming apparatus.

The present invention relates to a refill toner container, and a process cartridge.

The process cartridge in this specification is in the form of a cartridge which integrally comprises a charging means, a developing means, a cleaning means, and an electrophotographic photosensitive member. The charging means, the developing means, and the cleaning means are processing means. Also, the processing cartridge may comprise only one of the processing means and the electrophotographic photosensitive member, or may comprise the developing means and the electrophotographic photosensitive member. This process cartridge is removably installable in the main assembly of an electrophotographic image forming apparatus, for example, an electrophotographic copying machine, an electrophotographic printer, a word processor, or the like, which forms an image on recording medium.

A conventional image forming apparatus based on an electrophotographic image formation process employs a process cartridge system. According to this system, an electrophotographic photosensitive member, and one or more processing means which act on the electrophotographic photosensitive member, are integrated in the form of a cartridge which is removably installable in the main assembly of an image forming apparatus. This system remarkably improves the operational efficiency of the image forming apparatus since it allows a user to maintain the apparatus without relying on maintenance personnel. Therefore, the process cartridge system is widely used in the field of the image forming apparatus.

It is known that some process cartridges employed in the cartridge system are enabled to be replenished with toner (U.S. Pat. No. 5,034,776, Japanese Laid-Open Patent Application No. 186375/1990, and the like).

The aforementioned U.S. Pat. No. 5,034,776, and Japanese Laid-Open Patent Application No. 186375/1990 disclose process cartridges which allows a plurality of refill toner containers to be inserted in their internal space.

The conventional technologies mentioned in the aforementioned patent or patent application are very effective when used with the toner replenishable process cartridge.

The present invention resulted from the further development of the aforementioned technologies.

SUMMARY OF THE INVENTION

Accordingly, it is a principal object of the present invention to provide a toner accommodation container, a process cartridge and an electrophotographic image forming apparatus, wherein operativity of toner supply is improved.

It is another object of the present invention to provide a toner accommodation container, a process cartridge and an electrophotographic image forming apparatus, wherein toner supply can be carried out without toner scattering.

It is a further object of the present invention to provided a toner accommodation container, a process cartridge and an electrophotographic image forming apparatus, wherein toner sealing is improved.

According to an aspect of the present invention, there is provided a toner accommodation container for containing toner to be used for developing a latent image formed on a electrophotographic photosensitive member, wherein the toner accommodation container is supplied with toner from a toner supply container comprising: a toner accommodating portion for accommodating the toner; a toner supply opening for supplying; a cover member for covering the toner supply opening, wherein the cover member is movable between a closing portion for covering the toner supply opening and an open position for permitting supply of the toner therethrough; a blocking member, provided inside the covering member, for preventing the toner from scattering from the toner accommodating portion to outside, the blocking member is locked by a first locking member and a second locking member; wherein the blocking member is movable to the open position by the first locking member being released by the toner supply container and the second locking member being released by the cover member.

According to another aspect of the present invention, there is provided a process cartridge detachably mountable to a main assembly of an image forming apparatus comprising: a electrophotographic photosensitive member; process means actable on the photosensitive member; a toner accommodation container for containing toner to be used for developing a latent image formed on the electrophotographic photosensitive member, the toner accommodation container including: a toner accommodating portion for accommodating the toner; a toner supply opening for supplying; a cover member for covering the toner supply opening, wherein the cover member is movable between a closing portion for covering the toner supply opening and an open position for permitting supply of the toner therethrough; a blocking member, provided inside the covering member, for preventing the toner from scattering from the toner accommodating portion to outside, the blocking member is locked by a first locking member and a second locking member; wherein the blocking member is movable to the open position by the first locking member being released by the toner supply container and the second locking member being released by the cover member.

According to a further aspect of the present invention, there is provided an electrophotographic image forming apparatus, for forming an image on a recording material, to which a process cartridge is detachably mountable comprising: means for mounting a process cartridge which includes: a electrophotographic photosensitive member; process means actable on the photosensitive member; a toner accommodation container for containing toner to be used for developing a latent image formed on the electrophotographic photosensitive member, the toner accommodation container including: a toner accommodating portion for accommodating the toner; a toner supply opening for supplying; a cover member for covering the toner supply opening, wherein the cover member is movable between a closing portion for covering the toner supply opening and an open position for permitting supply of the toner therethrough; a blocking member, provided inside the covering member, for preventing the toner from scattering from the toner accommodating portion to the outside, the blocking member is locked by a first locking member and a second locking member; wherein the blocking member is movable to the open position by the first locking member being released by the toner supply container and the second locking member being released by the cover member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
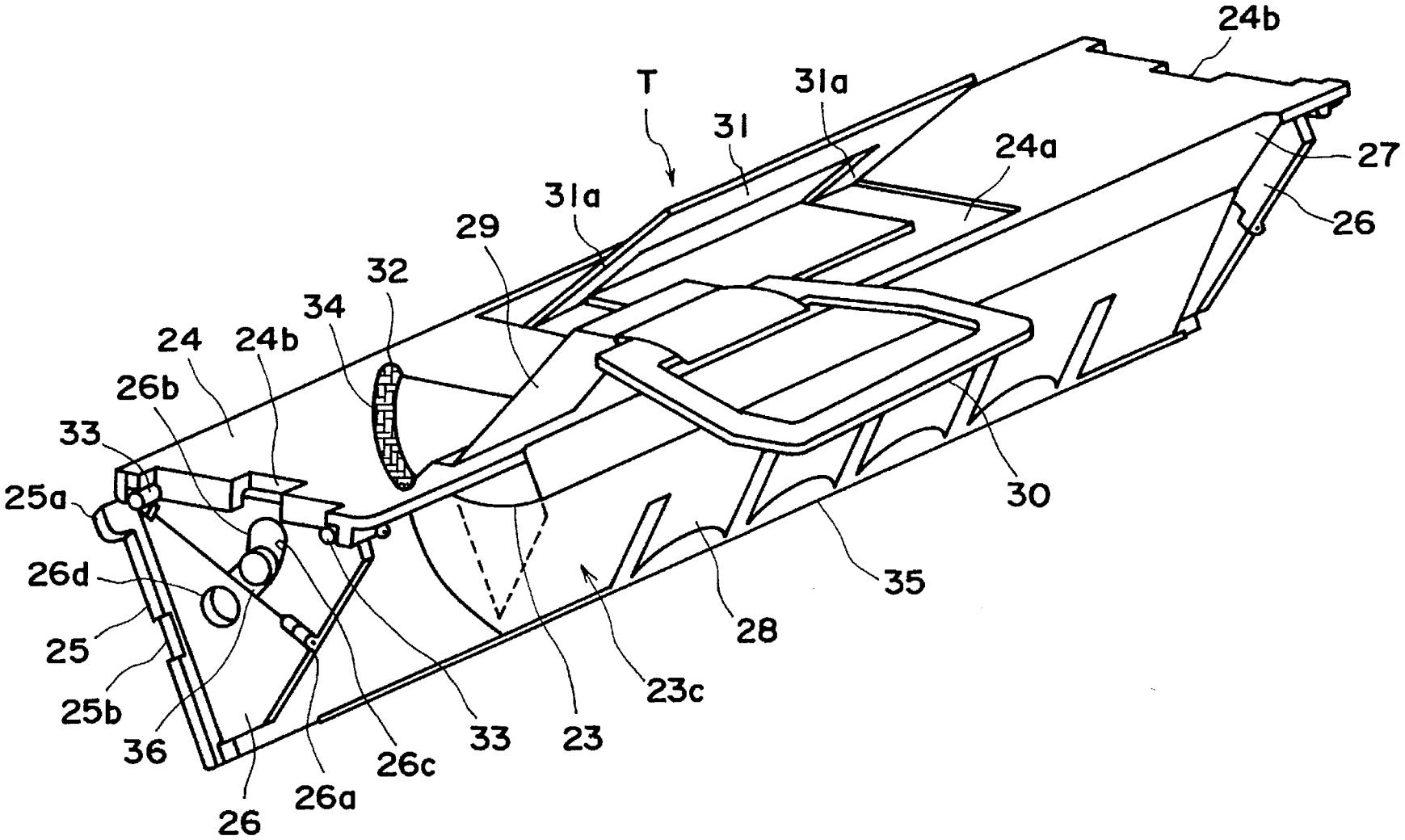
FIG. 1 is a perspective view of the toner cartridge in the first embodiment of the present invention.

Hereinafter, the electrophotographic image forming apparatus, a process cartridge, a refill toner container (hereinafter, toner cartridge), which are in accordance with the present invention, will be described with reference to the drawing.

First, referring to FIGS. 22–29, a typical electrophotographic image forming apparatus capable of accommodating the process cartridge in accordance with the present invention will be described.

As for the order of the descriptions, the general structures of the image forming apparatus and the process cartridge will be described first, and then, the refill toner container will be described.

{General Structure}

Figure 22:
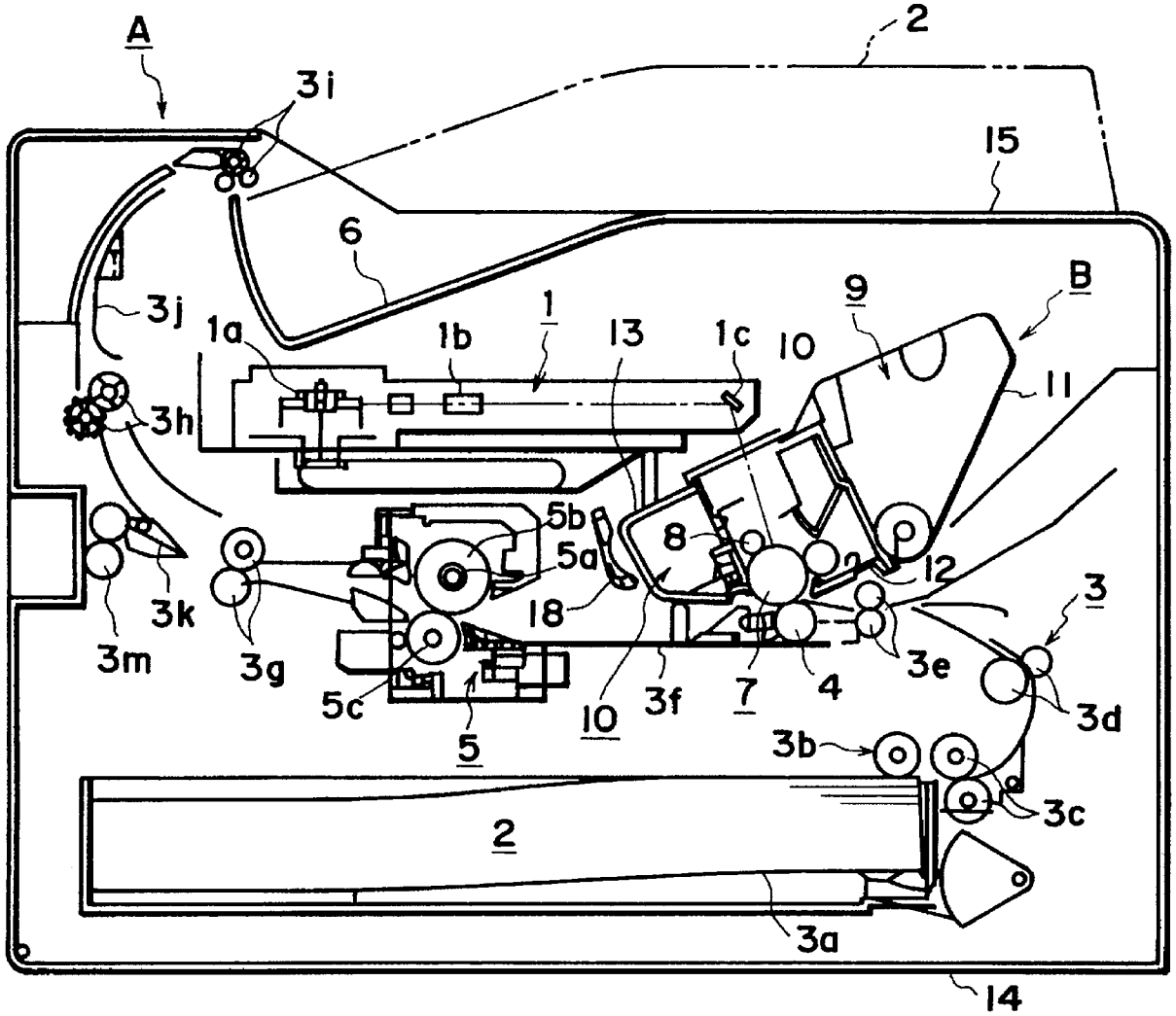
FIG. 22 is a schematic sectional view of a typical electrophotographic image forming apparatus capable of accommodating the process cartridge in accordance with the present invention.
Figure 23:
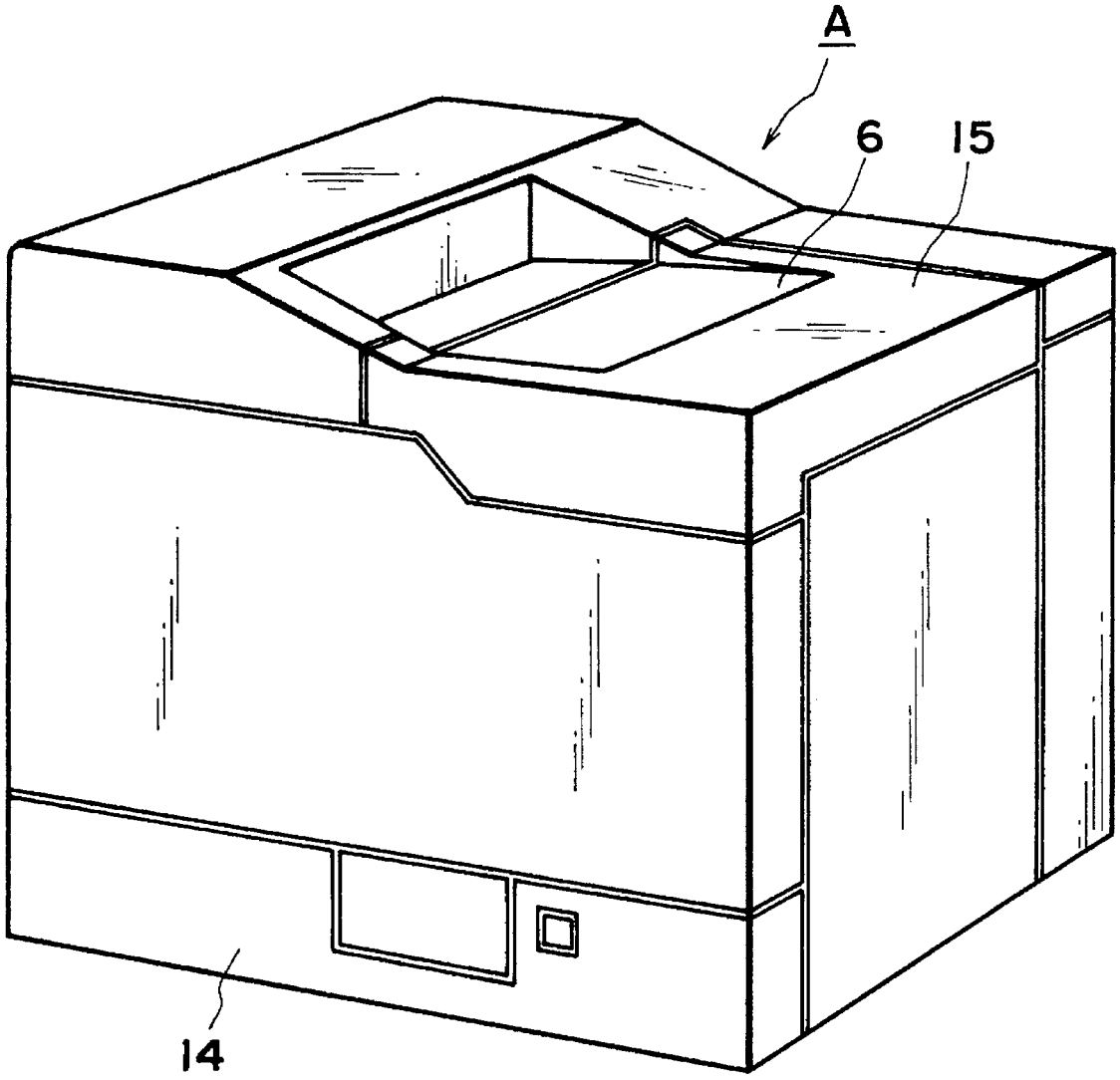
FIG. 23 is an external perspective view of the image forming apparatus illustrated in FIG. 22.

Referring to FIGS. 22 and 23, this image forming apparatus A is provided with an optical means which comprises a rotary polygon mirror 1*a*, a lens 1*b*, and a deflection mirror 1*c*. A light beam reflecting image data is emitted from a laser light source, and is projected by the optical means 1, to scan the surface of a photosensitive drum 7 as the electrophotographic photosensitive member. As a result, a latent image is formed on the surface of the photosensitive member 7. This latent image is developed into a toner image by a developing means 9 which uses toner.

In synchronism with the formation of the toner image, a sheet of recording medium 2 is delivered from a sheet feeder cassette 3*a* to an image forming station of a process cartridge B by a sheet feeding means 3 which comprises a pickup roller 3*b*, conveyer roller pairs 3*c* and 3*d*, a registration roller pair 3*e*, and the like, wherein the recording medium 2 is turned during the delivery. In the image forming station, the toner image formed on the photosensitive drum 7 is transferred onto the recording medium 2 by applying voltage to a transfer roller 4 as a transferring means.

After the toner image transfer, the recording medium 2 is guided to a fixing means 5 by a guide member 3*f*. The fixing means 5 comprises a fixing roller 5*b* containing a heater 5*a*, and a driving roller 5*c* which presses the recording means 2 on the fixing roller 5*b* as well as advances it. As a result, the toner image is fixed to the recording medium 2. Then, the recording medium with the fixed toner image is further conveyed through a turning path 3*j*, and discharged into a discharge tray 6, by discharge roller pairs 3*g*, 3*h* and 3*i*. Regarding the recording medium discharge, a switchable flapper 3*k* may be activated to discharge the recording medium 2 straight forward by a discharge roller pair 3*m*, without sending the recording medium 2 through the turning path 3*j*.

Figure 24:
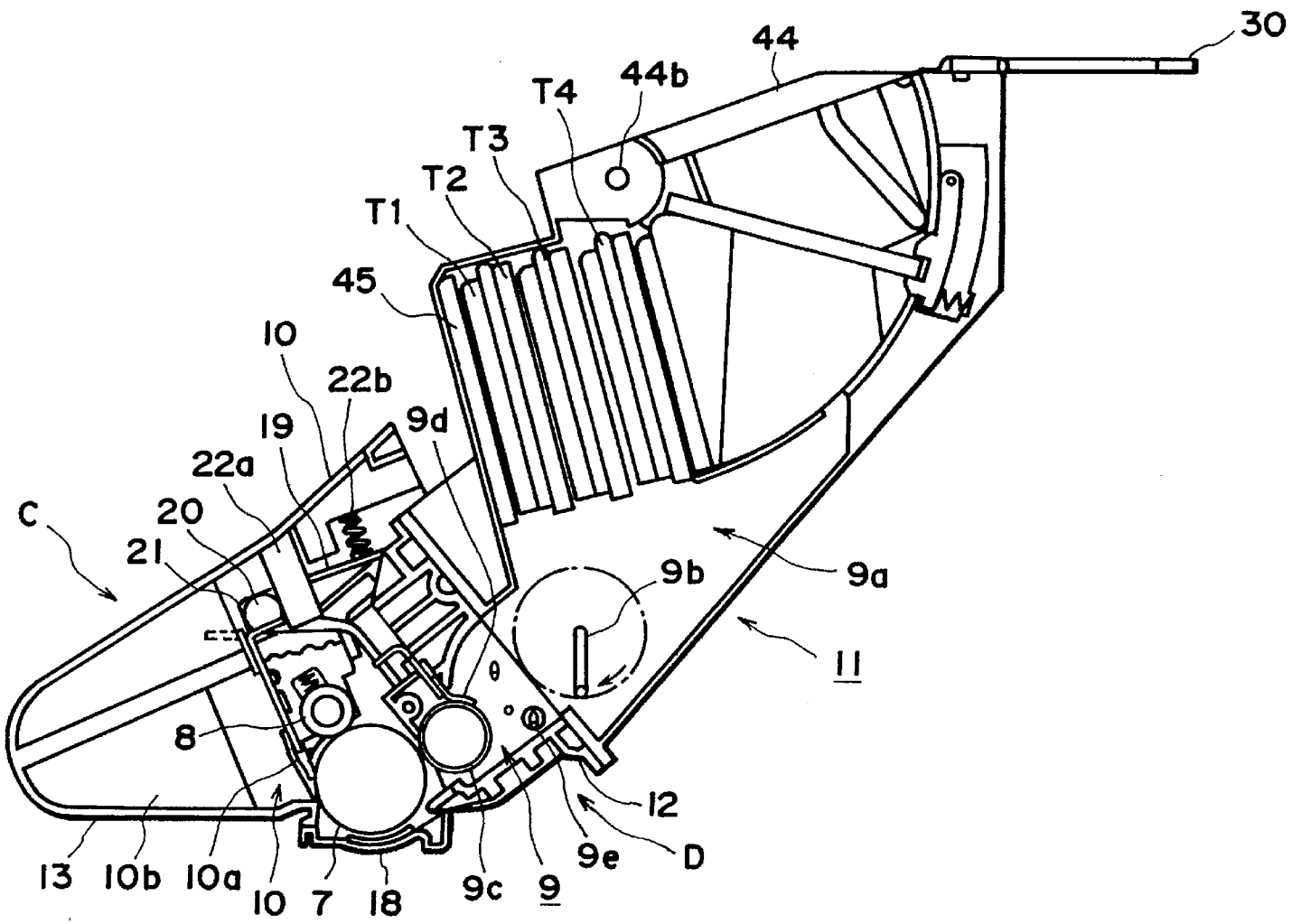
FIG. 24 is a sectional view depicting the structure of a typical process cartridge installable in the image forming apparatus illustrated in FIG. 22.
Figure 25:
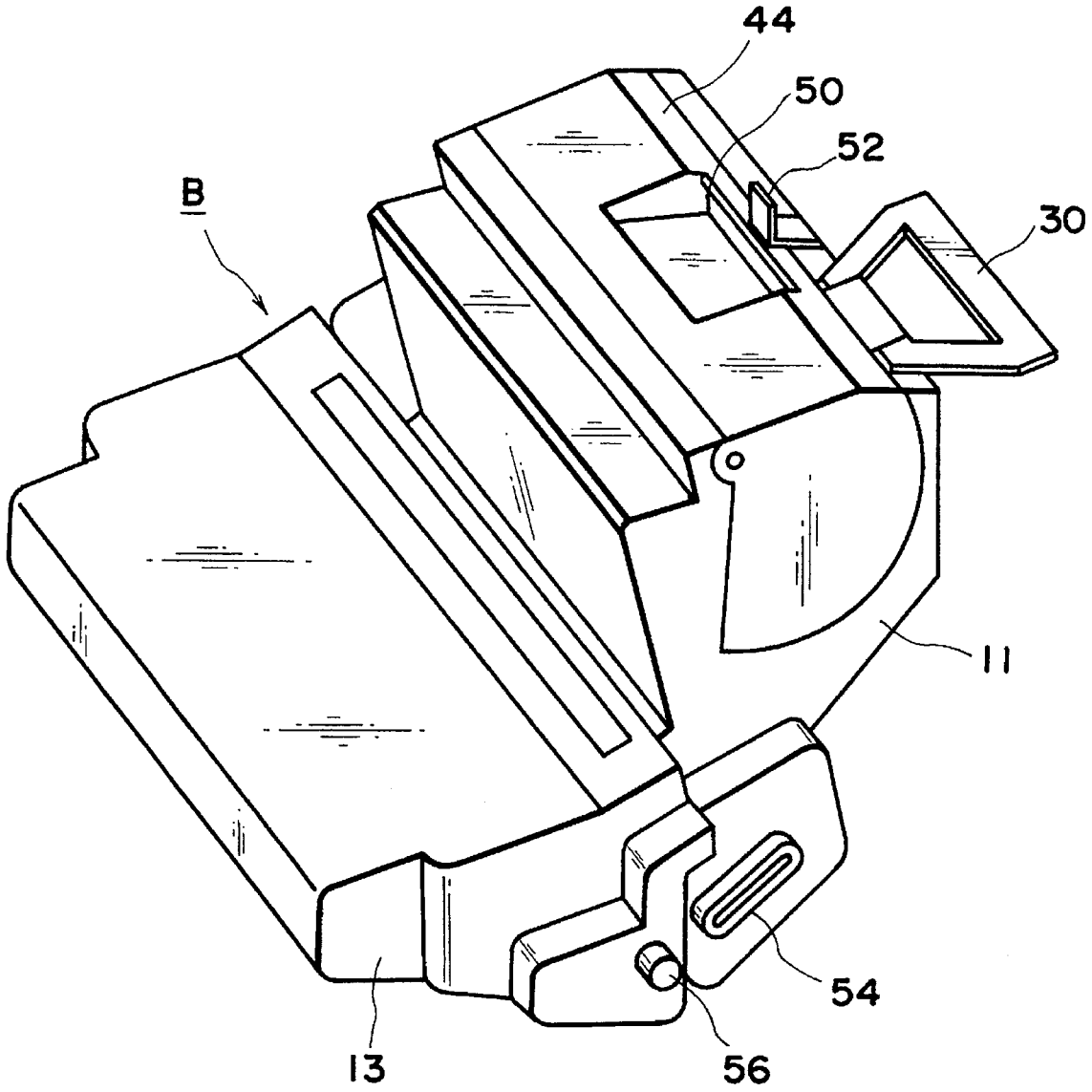
FIG. 25 is an external perspective view of the process cartridge illustrated in FIG. 24.

Next, referring to FIGS. 24 and 25, in the process cartridge B containing the image forming station, while a photosensitive drum 7 provided with a photosensitive layer is rotated, a predetermined level of voltage is applied to a charge roller 8 as a charging means. As a result, the surface of the photosensitive drum 7 is uniformly charged. Then, the uniformly charged surface of the photosensitive drum 7 is exposed to the scanning beam projected from the optical means 11 through an exposure opening 10. As a result, the latent image is formed on the surface of the photosensitive drum. The latent image is developed by the developing means 9. It should be noted that the charge roller 8 is in contact with the photosensitive drum 7, being thereby rotated by the rotation of the photosensitive drum 7.

In the developing means 9, as a toner feeding member 9*b* is rotated, the toner within a toner storing portion 9*a* is sent toward the development roller 9*c*. As the development roller 9*c* containing a fixed magnet is rotated, a triboelectrically charged toner layer is formed on the surface of the development roller 9*c* by a blade 9*d*. The toner in this toner layer is transferred onto the surface of the photosensitive member 7 in correspondence to the aforementioned latent image, whereby a toner image, that is, a visual image, is formed on the photosensitive drum 7.

Next, a voltage with a polarity opposite to the toner image polarity is applied to the transfer roller 4, whereby the toner image is transferred onto the recording medium 2. Thereafter, the toner remaining on the photosensitive drum 7 is removed by a cleaning means 10 comprising a cleaning blade 10 and a waste toner collector 10*b*; the residual toner on the photosensitive drum 7 is scraped off and collected into the waste toner collector, by a cleaning blade 10*a*, preparing the photosensitive drum 7 for the following process. The cleaning blade 10*a* is in contact with the photosensitive drum 7.

Various components such as the photosensitive drum 7 are integrally disposed within a housing which is formed by joining first a toner container 11 and a developing frame 12, and then, a cleaning frame 13; a process cartridge B is formed. This process cartridge B is removably installed in a cartridge accommodating means provided within the main assembly 14 of the image forming apparatus.

Figure 26:
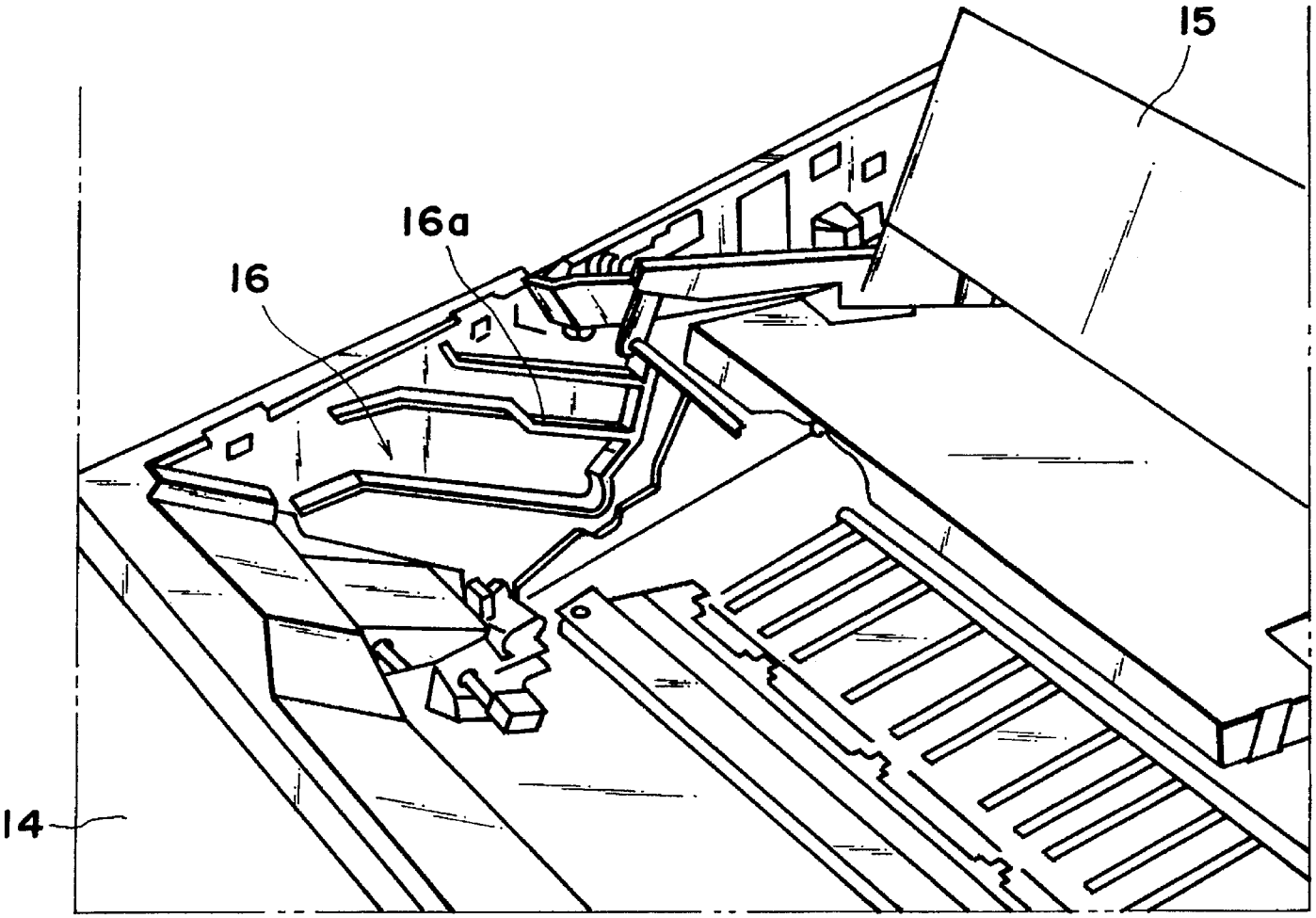
FIG. 26 is a perspective view of the portion of the main assembly of an image forming apparatus, where the process cartridge illustrated in FIG. 25 is installed.
Figure 27:
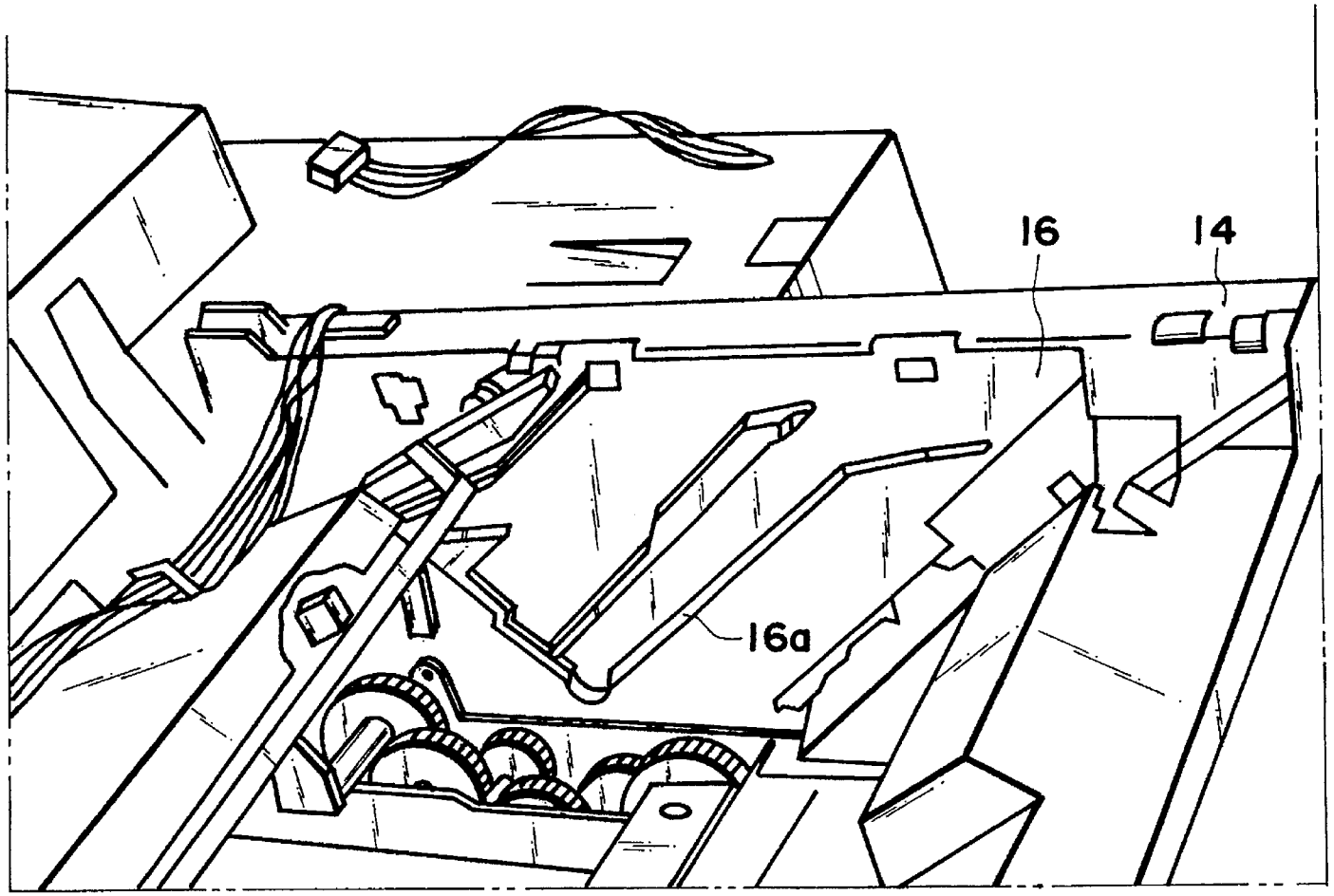
FIG. 27 is a perspective view, as seen from an angle different from the angle in FIG. 26, of the portion of the main assembly of an image forming apparatus, where the process cartridge illustrated in FIG. 25 is installed.

Next, referring to FIGS. 26 and 27, as a lid 15 of the cartridge accommodating means is opened, a cartridge accommodating space is exposed. A cartridge accommodating member 16 (guide member) is attached to each of the lateral walls of the apparatus main assembly 14. Both the left and the right guide members are provided with a guiding portion 16*a*. The process cartridge B is inserted to follow the guide portion 16*a*. Thereafter, the lid 15 is closed, ending the sequence for installing process cartridge B into the image forming apparatus A.

{Structure of Housing}

The housing of the process cartridge B in this embodiment is formed by joining the toner container 11, the developing frame 12, and the cleaning frame 13. Below, the structure of the housing will be described.

Referring to FIG. 24, the toner container is provided with a toner storing space 9*a*, in which the toner feeding member 9*b* is disposed. The development roller 9*c* and the developing blade 9*d* are mounted in the developing frame 12. A stirring member 9*e* for circulating the toner within the development chamber is rotatively mounted adjacent to the development roller 9*c*. The toner container 11 and the developing frame 12 are joined by welding to form a developing unit D.

The photosensitive drum 7, the charge roller 8, and the cleaning means 10 are mounted in the cleaning frame 13, and then, a drum shutter 18 is attached to the cleaning frame 13, completing a cleaning unit C. When the process cartridge B is removed from the apparatus main assembly 14, the drum shutter 18 covers the photosensitive drum to protect it.

Figure 28:
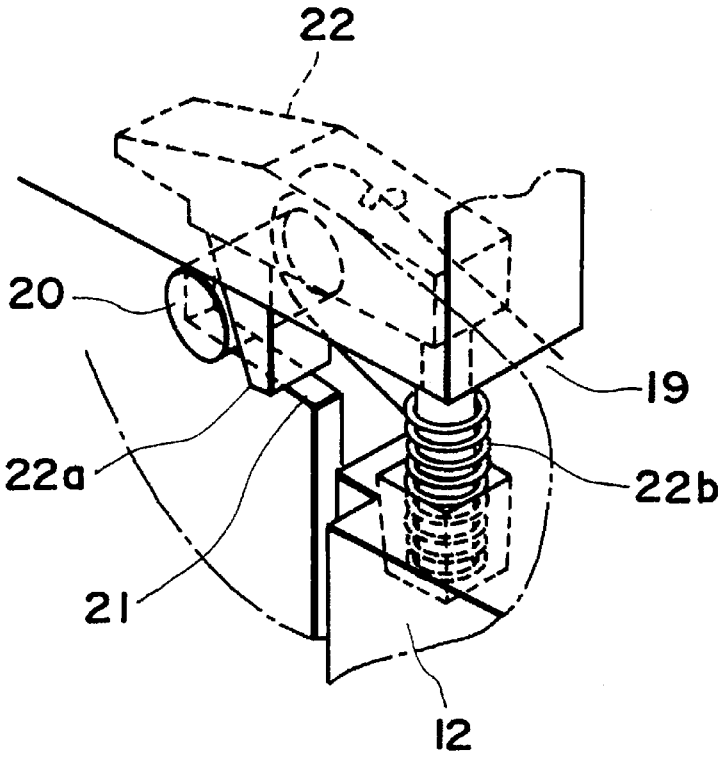
FIG. 28 is an explanatory drawing depicting components related to the installation of the process cartridge illustrated in FIG. 25.
Figure 29:
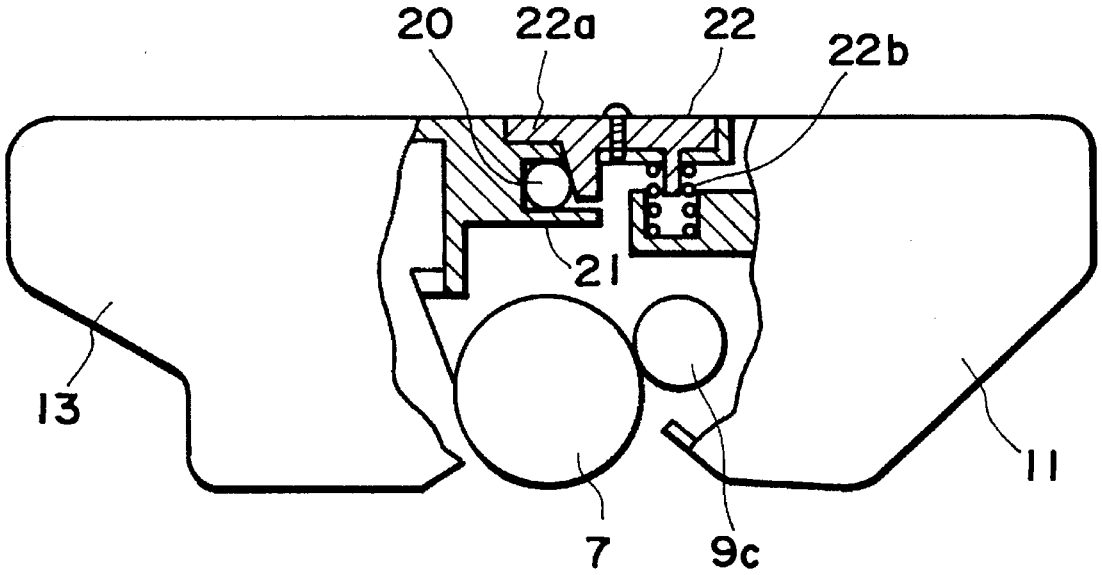
FIG. 29 is a sectional view of the member illustrated in FIG. 28.

Next, the development unit D and the cleaning unit C are joined to form a process cartridge B. Each longitudinal end of the developing frame 12 is covered with an unillustrated cover member which rotatively supports the correspondent end of the development roller 9*c*. This cover member is provided with an arm 19, and a rotational axis 20 is formed at the end of the arm 19 as shown in FIGS. 28 and 29, which illustrate only one side of the process cartridge B.

Further, at each longitudinal end of the cleaning frame 13, a recess 21 for positioning the rotational axis 20 is provided. The rotational axis 20 is inserted in this recess 21, and then, a joining member 22 with a projection 22*a* is attached to the cleaning frame 12 using a screw, whereby the developing unit D and the cleaning unit C are joined in such a manner that they become rotatable about the rotational axis 20, allowing the development roller 9*c* to be pressed onto the photosensitive member 7 by the weight of the developing unit D itself.

Further, the developing frame 12 is placed under the downward pressure from a compression spring 22*b* attached to the joining member 22, so that the development roller 9*c* is reliably pressed toward the photosensitive member 7. Further, an illustrated spacer ring is mounted at each of the longitudinal ends of the development roller 9*c*, and this ring is pressed on the photosensitive drum 7, maintaining a predetermined gap between the photosensitive drum 7 and development roller 9*c*.

Again, referring to FIG. 25, the process cartridge B is provided with a cover member 44 for covering or exposing the opening. The substantially central portion of the cover member 44 is provided with a handhold portion 50 for making it easier to open or close the cover member 44. Further, when the toner cartridge is placed in the process cartridge B with the cover member 44 closed, a tear tape handle 30, which is used to unseal the toner cartridge to replenish the process cartridge B with the toner, projects from the process cartridge. This will be described in more detail later. It should be noted here that the cover member 44 covers an opening 9*g* provided at the top of the toner storing portion 9*a*, and is openable when the toner is supplied into the toner storing portion 9*a*.

Further, the process cartridge is provided with a locking means 52 for locking the cover member 44. The locking means 52 is disposed at a location adjacent to the handhold portion 50 of the closed Cover member 44. When the locking means 52 is rotated. upward and to the right, the cover member 44 is unlocked becoming ready to be opened.

Further, the process cartridge B comprises guides 54 and 56, which are located at each longitudinal end of the process cartridge B, and are used for installing the process cartridge B into the image forming apparatus main assembly.

Next, the process cartridge B in accordance with the present invention, and the toner cartridge C in accordance with the present invention, will be described.

Embodiment 1

Figure 2:
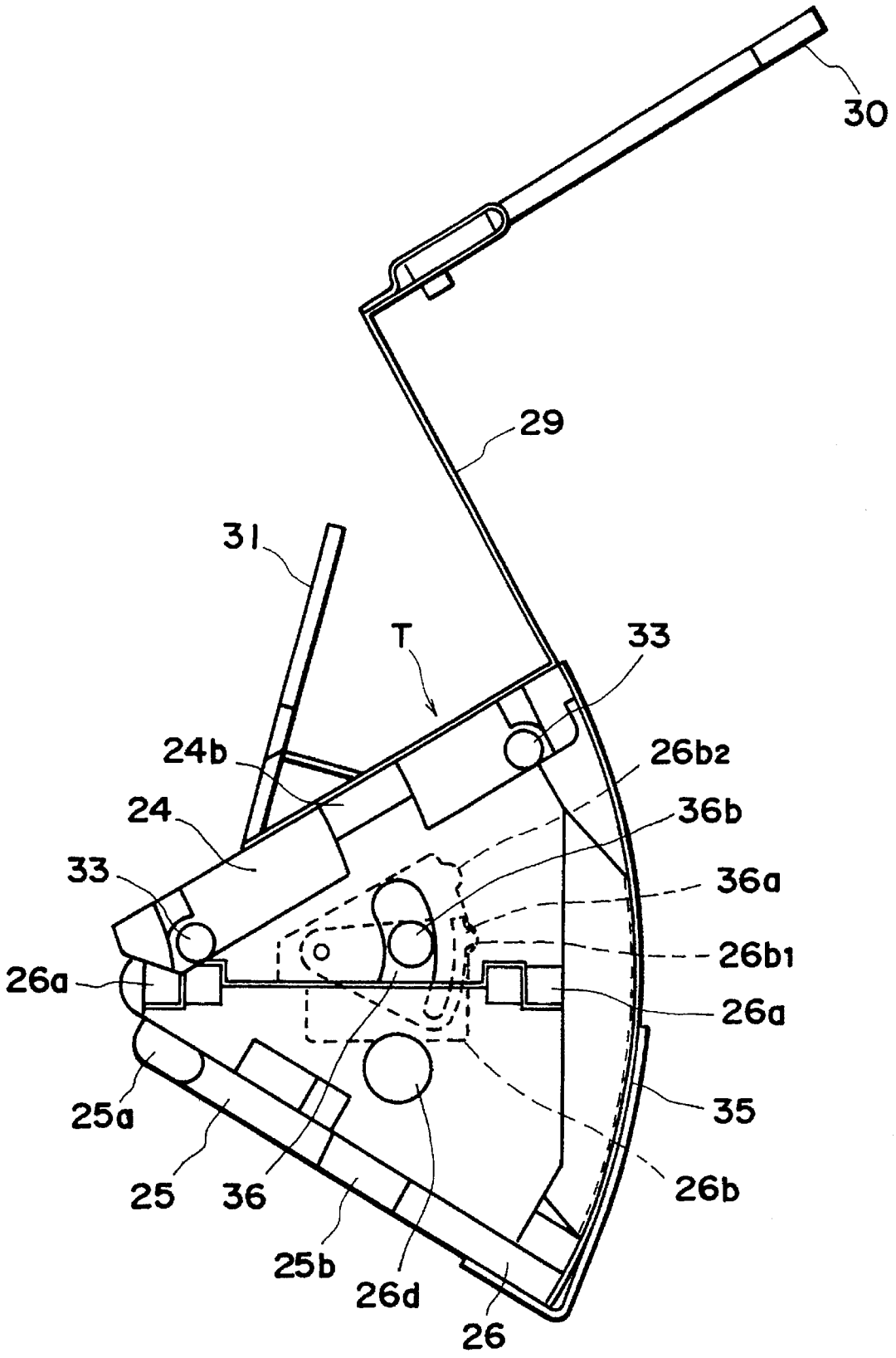
FIG. 2 is a side view of the toner cartridge illustrated in FIG. 1.
Figure 3:
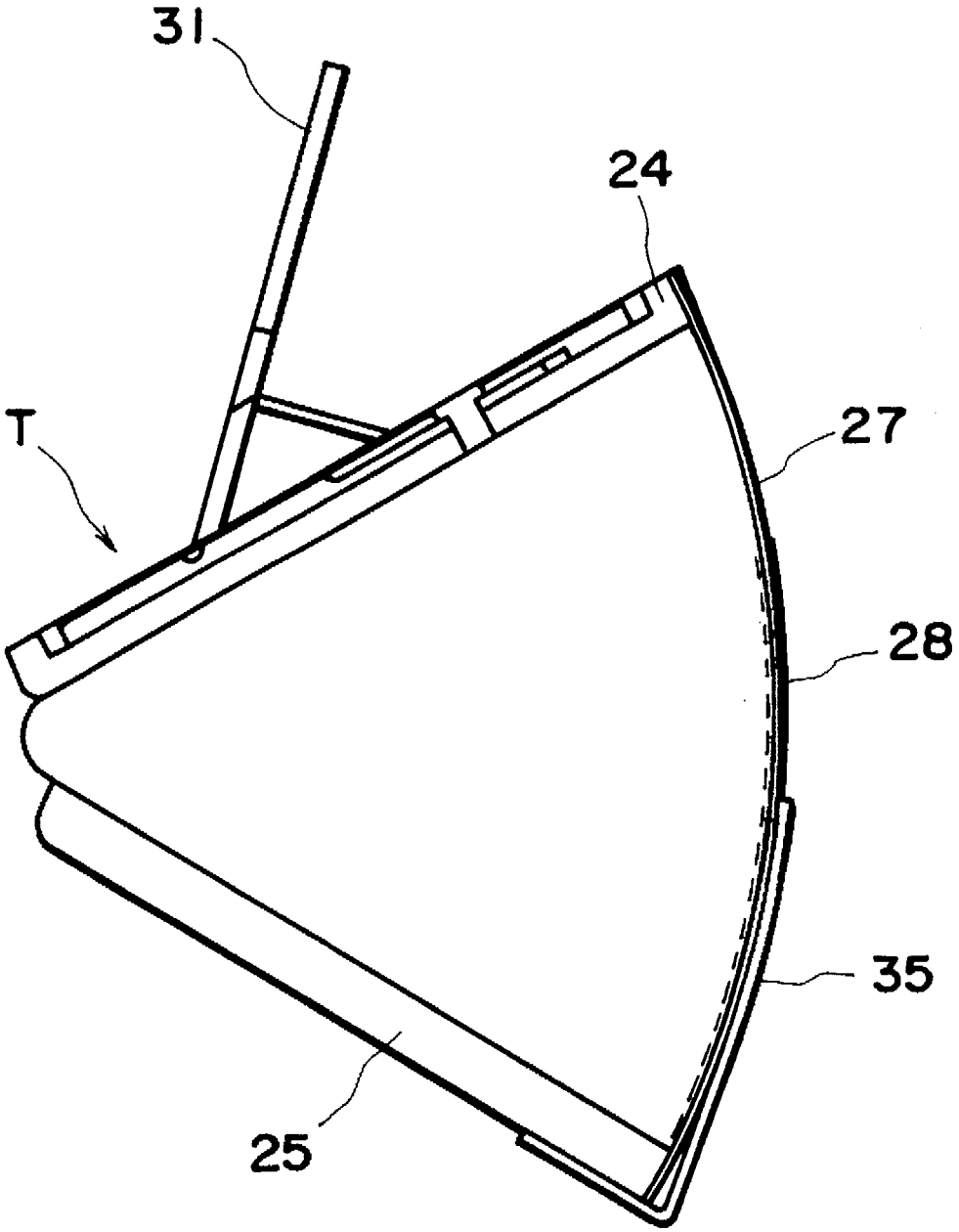
FIG. 3 is a sectional view of the toner cartridge illustrated in FIG. 1.

Referring to FIGS. 1–3, a toner cartridge T is substantially in the form of a triangular column, and comprises a toner storing container 23 for containing the toner, a top guide plate 24, a bottom guide plate 25, and substantially triangular side plates 26 and 26. The top and bottom guide plates 24 and 25 are holding means for holding the toner storing container 23, and are held together at their longitudinal ends by the side plates 26. In other words, the toner cartridge T has a substantially triangular cross section or a substantially rectangular cross section.

Figure 4:
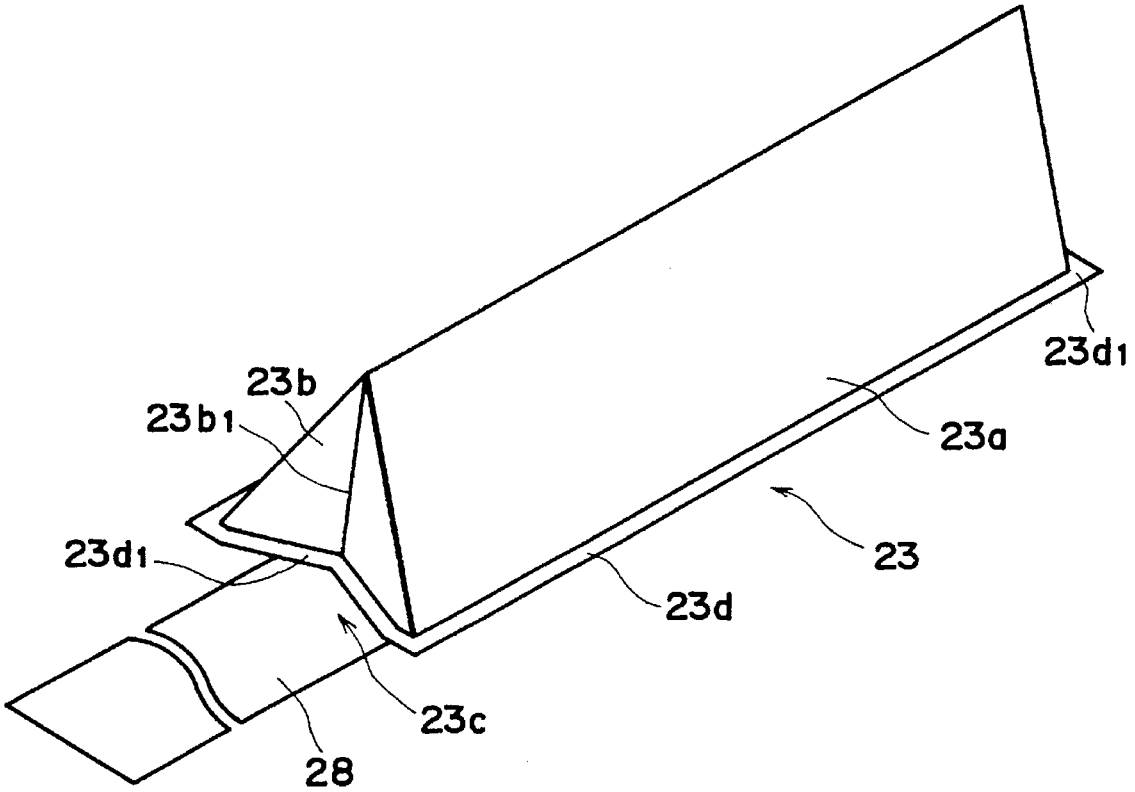
FIG. 4 is a perspective view of the toner storing container contained in the toner cartridge illustrated in FIG. 1.
Figure 5:
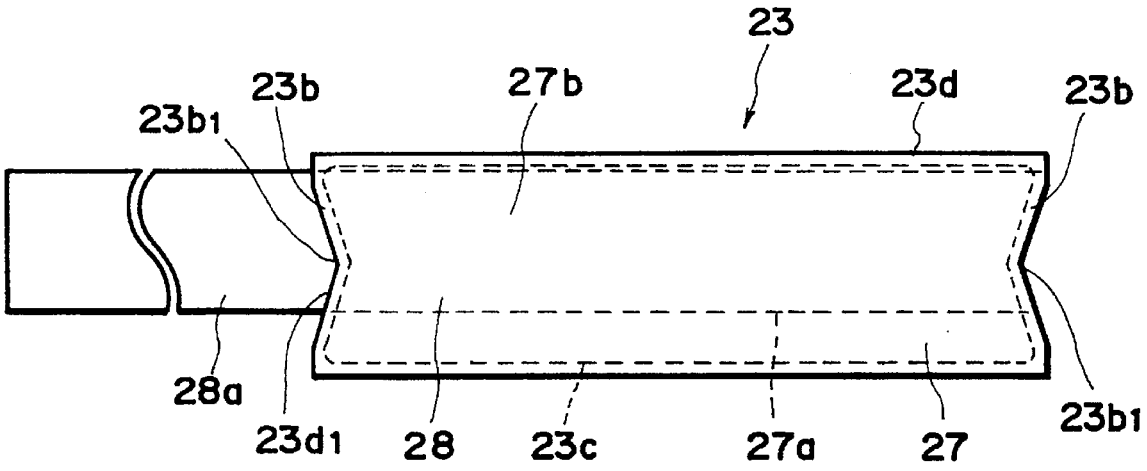
FIG. 5 is a plan view of the toner storing container illustrated in FIG. 4, as seen from below.
Figure 6:
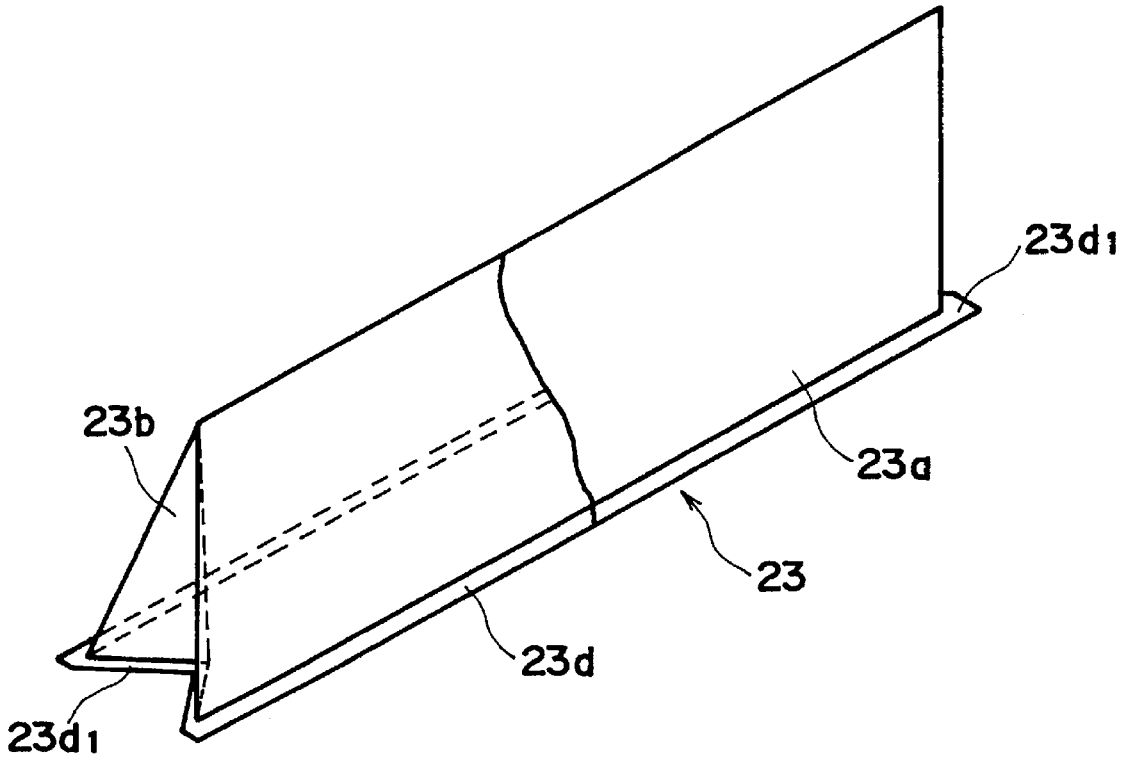
FIG. 6 is a perspective view depicting how the toner cartridge illustrated in FIG. 4 is folded.

Referring to FIGS. 4–6, the toner storing container 23, which is a flexible container, is in the form of a substantially triangular column, and comprises a V-shaped main body section 23*a* for storing the toner, wherein the portion equivalent to the open end of the character V is an opening 23*c*. The toner storing container 23 further comprises side wall sections 23*b* located at each longitudinal end of the main body section 23*a*, a flange 23*d* surrounding the entire edge of the opening 23*c*, and a sealing member for sealing the opening 23*c*. The sealing member will be described later.

In the case of the toner storing container in this embodiment 23, which is in the form of a substantially triangular column as described before, the side wall portion 23*a* and the portion 23*d*1 of the flange 23*d* are bent inward so that when the V-shaped main body section 23*a* is pressed from the direction perpendicular to the longitudinal direction of the V-shaped main body section 23*a* after the completion of a toner refilling operation, the side wall portion 23*b* is reliably folded inward of the main body section 23*a* (FIG. 6). In other words, the center portion of the portion 23*d*1 of the flange 23*d*, and the center portion of the side wall 23*b*, that is, the portion equivalent to the vertical line 23*b*1 drawn from the top vertex of the triangular side wall 23*d*, are recessed. Therefore, as seen from the opening 23*c* side, the both side walls of the toner storing container 23 substantially look like a character M as illustrated in FIG. 5. That is, the inwardly projecting portion 23*b*1 of the side wall portion 23*b* connects the center portion of the longitudinal end edge of the opening 23*c* and the farthest vertex of the substantially triangular side wall 23*d* from the longitudinal end edge of the opening 23*c*; the inwardly projecting portion 23*b*1 of the side wall portion 23*b* can be compared to the line connecting the pivot portion of a fan to the center portion of the edge of the open fan.

As for the toner storing container material, in order to assure that the toner storing container 23 is reliably collapsible with application of only a small amount of pressure, soft material such as polypropylene, polyethylene, vinyl chloride, nylon, or the like is used. Further, in order to reduce the wall thickness, the toner storing container 23 is formed by vacuum molding. More specifically, a 0.6 mm thick polyethylene-polypropylene laminate sheet was used, and the wall thickness of the finished product ranged from 0.2 mm to 0.6 mm. Also regarding the wall thickness of the finished product, the thickness of the side wall portion 23*b* and the portion 23*d*1 of the flange 23*d* are preferred to be in a range of 0.1–1.0 mm so that they can be easily collapsed with the application of only a small amount of force. That is, when the wall thickness is no more than 0.1 mm, it is liable that a pin hole may develop, which is liable to result in toner leakage; when it is no less than 1 mm, compression strength is larger, making it difficult to collapse the toner storing container 23.

The provision of the aforementioned structure assures that the toner storing container is easily collapsible or foldable with the application of only a small amount of pressure.

The opening 23*c* of the toner storing container 24 is sealed with a sealing member which is fixed to the flange 23*d* using means such as gluing, welding, or the like.

The sealing member may be formed of a plain easy peel film such as one used for the conventional toner storing container, but in this embodiment, a tear tape unit illustrated in FIG. 5 is employed to reduce the tear resistance of the sealing member, that is, to make it easier to unseal the toner storing container. The tear tape unit comprises a cover film 27 for covering the opening 23*c*, and a tear tape 28 which is laid in contact with the cover film 27. The rear tape 28 extends from one longitudinal end of the opening 23*c* to the other end, partially covering the opening 23*c* by a width defined by one of the longitudinal edges of the opening 23*c* and a tear line 27*a*, and then, is folded back, being extended backward beyond the starting point. With the provision of this structure, the toner storing container can be unsealed by pulling the end portion of the extended folded portion 28*a* of the tear tape 28. This is, the cover film 27 is torn along the tear line 27*a* by pulling the extended folded portion 28*a* of the tear tape 28, and is peeled away from the flange 23*d*. As a result, the opening 23*c* is exposed to release the toner, though a portion of the cover film 27 remains partially covering the opening 23*c*.

Figure 7:
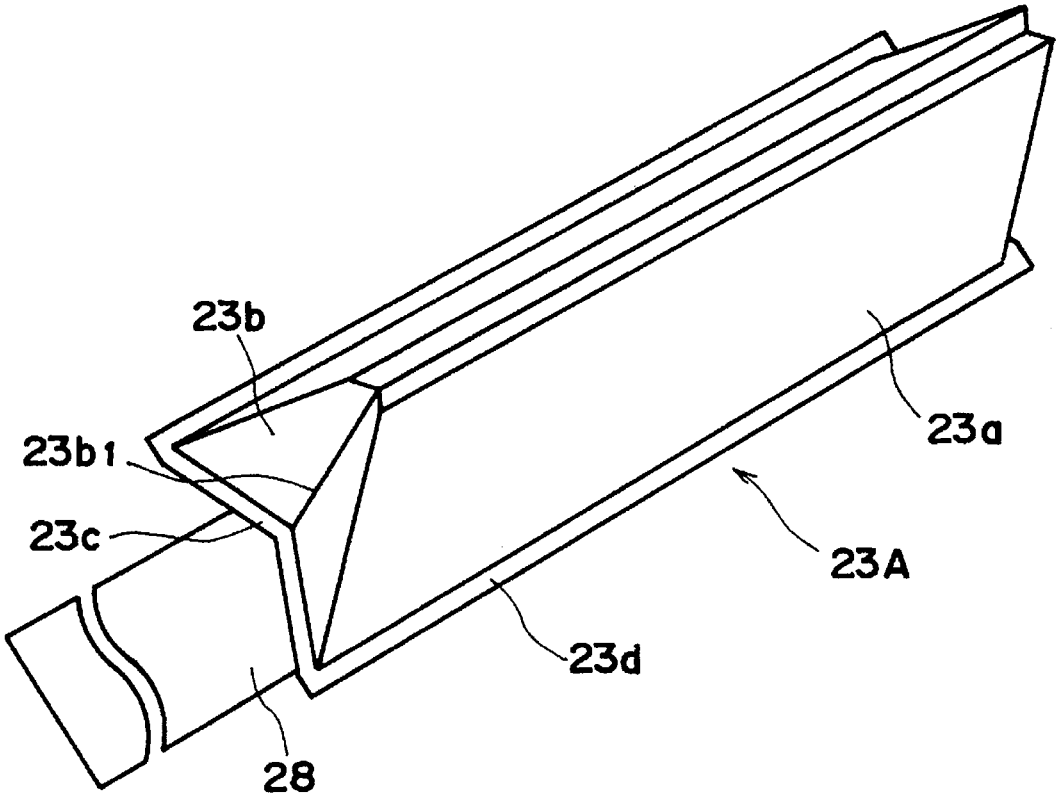
FIG. 7 is a perspective view of the toner cartridge in another embodiment of the present invention.

In this embodiment, the configuration of the toner storing container 23 is such that its cross section is substantially triangular, but this configuration is not mandatory. Instead, it may be shaped like a toner storing container 23A illustrated in FIG. 7, that is, a toner storing container having a cross section like a sector, which is accomplished by modifying the side plates 26 in such a manner that vertex portion of the side plate, and the edge opposing the vertex portion, form an arc-like configuration.

Again, referring to FIGS. 1–3, the end portion of the tear tape 28 is provided with a tear tape handle fixing plate 29, and a tear tape handle 30 is fixed to the tear tape handle fixing plate 29. The tear tape handle fixing plate 29 is removably attached to the top guide plate 24. When this tear tape handle 30 is pulled, the tear tape 28 is pulled. As a result, the cover film 27 is torn along the tear line 27*a*, creating an opening 27*b* which permits toner discharge. It should be noted here that the opening 27*b* is offset toward one of the longitudinal edges of the opening 23*c* of the toner storing container 23.

The V-shaped toner storing container 23 is provided with a top guide plate 24 and a bottom guide plate 25, wherein these guide plates 24 and 25 are mounted on the walls equivalent to the diagonal stroke portions of the character V, using an appropriate means. The top guide plate 24 is provided with an arc-shaped guide hole 32 formed by drilling. It is located adjacent to one of the longitudinal ends of the top guide plate 24. The tear tape 28 is put through this guide hole 32. The top guide plate 24 is also provided with an insertion handle 31, which is located on the top surface, at a substantially middle portion in the longitudinal direction.

The insertion handle 31 makes it easier to insert the toner cartridge C into the process cartridge B. Referring to FIG. 1, the insertion handle 31 is a U-shaped single piece component formed of a flexible resin material such as polypropylene (PP) or polyamide (PA). Its thickness is 1–2 mm, except for the base portion of the leg portions 31*a*. The base portion of the leg portion 31*a* is rendered thinner than the rest, being 0.3–0.8 mm thick, so that it becomes bendable enough to serve as a hinge.

Because of the above construction, that is, since the leg portion 31*a* of the insertion handle 31 is bendable at its bendable portion, the insertion handle 31 can be disposed into a recess 24*a* which is provided in the top surface of the top guide plate 24. The recess 24*a* has a configuration matching that of the insertion handle 31. The depth of the recess 24*a* equals the thickness of the insertion handle 31. Therefore, when the insertion handle 31 is fitted in the recess 24*a*, the outward facing surface of the insertion handle 31 becomes level with the top surface of the top guide plate 24, contributing to the saving of space.

In the normal state, the insertion handle 31 diagonally sticks out from the top surface of the top guide plate 24 so that it can be easily grasped.

Further, the top guide plate 24 is provided with four guide rollers 33; two guide rollers 33 are mounted on the surface of each longitudinal end, extending in the longitudinal direction of the top guide plate 24. These guide rollers 33 are fitted in guide grooves of the process cartridge, which will be described later, and regulate the position of the top guide plate 24. On the downward facing surface of the top guide plate 24, a wiping seal 34 is attached along the edge of the guide hole 32.

At each longitudinal end of the toner storing container, one of the edges of the side plate 26 is rotatively connected to the downward facing surface of the top guide plate 24.

Also at each longitudinal end of the toner storing container, the other edge of the side plate 26 is rotatively connected to the upward facing surface of the bottom guide plate 25.

The downward facing surface of the bottom guide 25 is provided with a cover 35 which covers the tear tape 28 along the longitudinal edge of the opening 23*c*, so that when the toner cartridge C is inserted into the process cartridge B, the tear tape 28 is prevented from being snugged.

Further, the bottom guide plate 25 is provided with a projection 25*a*, which is located at each longitudinal end of the bottom guide plate 25, at the corner opposite to the corner at which the cover 35 is attached, and projects in the longitudinal direction of the toner cartridge C. This projection 25*a* also regulates the movement of the bottom guide plate 25 in the same manner as the guide rollers 33 of the top guide plate 24 when the process cartridge C is inserted into the process cartridge B.

The side plate 26 is substantially triangular, and is rotatively connected to the top guide plate 24 and the bottom guide plate 25 by the corresponding edges, respectively. It is provided with a hinge portion 26*a* which perpendicularly extends from the center portion, that is, the vertex portion, to the edge opposing the vertex; therefore, it can be folded inward.

Further, referring to the drawings, in particular FIG. 2, a slit 26*b* is provided across the inward facing surface of the foldable portion of the side plate 26. In the slit 26*b*, a fan-shaped stopper 36 for preventing the side plate 26 from folding inward is fitted. The stopper 36 is provided with a claw 36*a* which engages with the stopper locking portion 26*b*1 or 26*b*2 of the slit 26*b*, and a columnar projection 36*b* which is movable along an arc-like hole formed by cutting the top guide plate side half of the side plate 26.

Normally, the projection 26*a* of the stopper 36 is in engagement with the first stopper locking portion 26*b*1, that is, the stopper is positioned across the foldable portion of the side plate 26, preventing the side plate 26 from being folded. However, when the stopper 36 is rotated counterclockwise, relative to the drawing, about an axis 36*c* using the projection 36*b*, the engagement between the projection 36*a* and the first stopper locking portion 26*b*1 is switched to the engagement between the projection 36*a* and the second stopper locking portion 26*b*2. The stopper 36 is retracted from the foldable portion toward the top guide plate 24, allowing the side plate 26 to be folded.

Further, the bottom guide plate side half of the side plate 26 is provided with a round hole 26*d* formed by drilling and having a diameter matching that of the columnar projection 36*b*. When the side plate 26 is folded, the projection 36 loosely fits in the hole 26*d*, not interfering with the folding of the side plate 26.

Further, each longitudinal end of the top guide plate 26 or the bottom guide plate 25 is provided with a cutaway portion 24*b* or 25*b*, respectively, for preventing the top or bottom guide plate 24 or 25 from interfering with the spring member of the process cartridge B, which will be described later.

Figure 8:
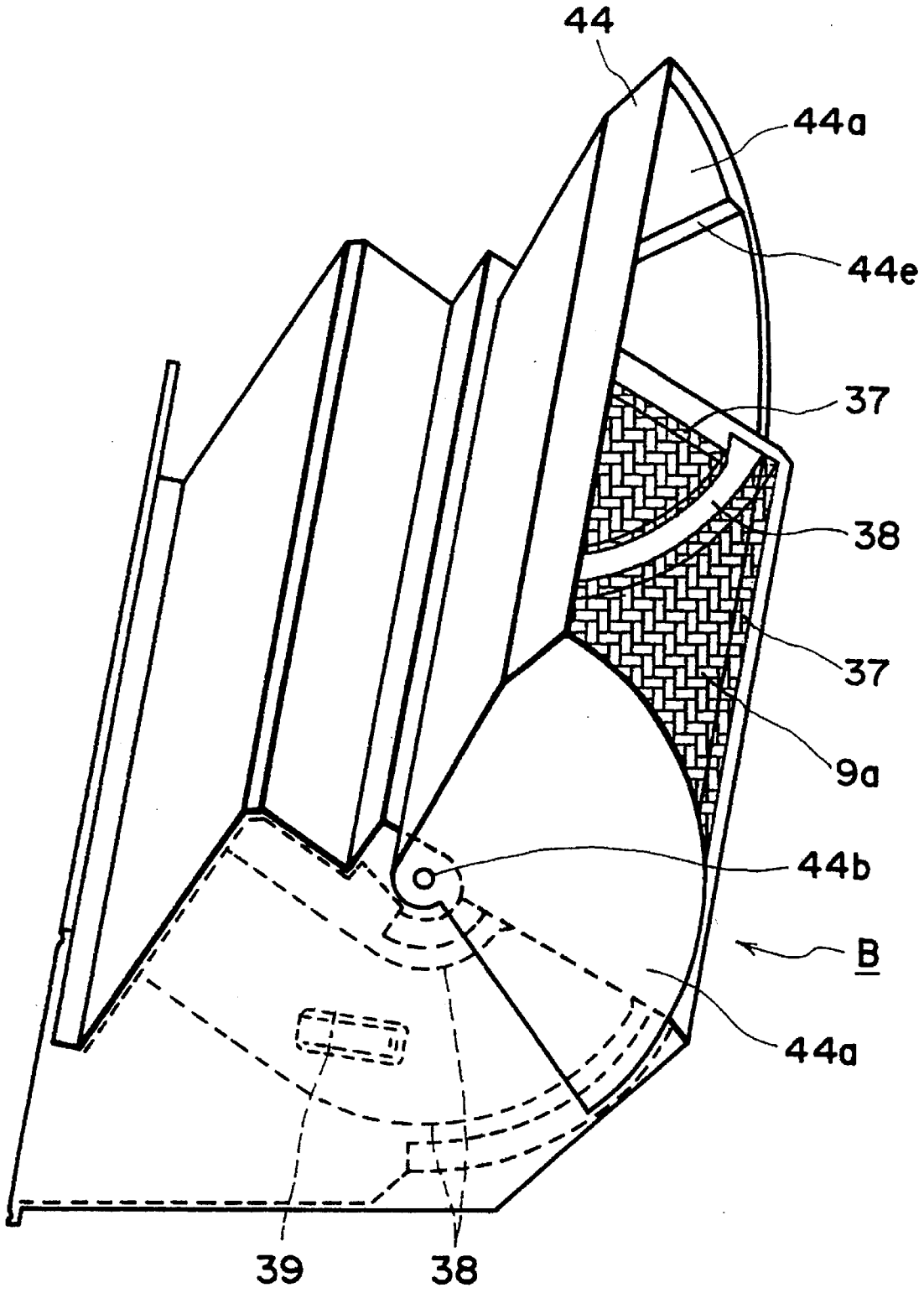
FIG. 8 is a perspective view of the process cartridge in an embodiment of the present invention.

Next, referring to FIGS. 8–10, the process cartridge B in accordance with the present invention will be described again, this time in more detail.

The opening 9*g* located at the top of the toner storing portion 9*a* is exposed or covered by opening or closing the cover member 44. The cover member 44 has fan-shaped side plates 44*a*. The fan-shaped side plate 44*a* is provided with an axial projection 44*b*. The location of the axial projection is equivalent to the location of the pivot of a fan. This axial projection 44*b* fits in a recess provided in the outward facing surface of the exterior wall of the toner storing portion 9*a* of the aforementioned process cartridge B, whereby the cover member 44 is rotatively connected to the process cartridge B.

On the back surface of the cover member 44, a pusher projection 44*d* for pushing the toner cartridge T into the toner storing portion 9*a*, and a guide rib 44*e* for guiding outward the tear tape 28, are provided.

On the inward facing surface of the front, rear, left, or right wall of the process cartridge B, which surrounds the toner storing portion 9*a*, a sealing member 37 made of MOLT PLANE, or the like having a predetermined thickness is bonded. Also, on the inward facing surface of the left or right side wall, two guide grooves 38 for guiding the inserted toner cartridge T, and a spring 39 for folding the inserted toner cartridge T, are provided.

The guide grooves 38 form an arc by the portion closer to the entrance for the toner cartridge T, and straighten toward the deeper end, wherein the two grooves 38 remain parallel to each other.

Figure 9:
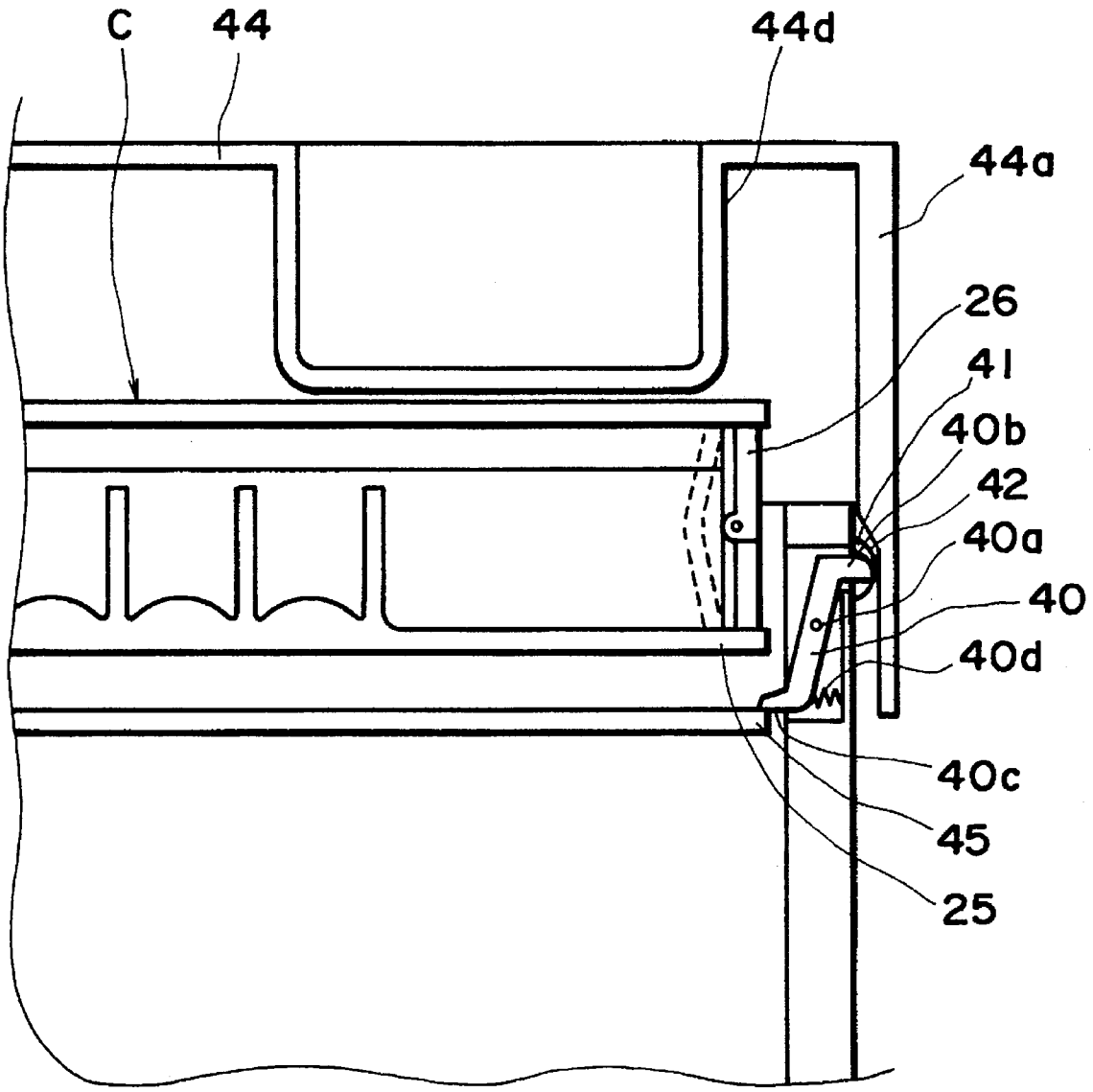
FIG. 9 is a schematic drawing depicting the essential portions of the process cartridge in which the toner cartridge has been inserted.

Referring to FIG. 9, on the left and right walls of the toner storing portion 9*a*, a first engagement claw 40 is attached, which comprises a central axial member 40*a*, and is rotatable about the axial member 40*a*. The first engagement claw 40 further comprises a first projection portion 40*b* extending outward from one end, and a second projection portion 40*c* extending inward from the other end; they extend in the opposite directions. Further, the left and right side walls of the toner storing portion 9*a* are provided with a window for allowing the first projecting portion 40*b* to project outward.

The window 41 is covered from outside with a flexible curtain 42. On the back surface of the second projecting portion 40*c* , a spring 40*d* for pressing inward the second projecting portion 40*c* is mounted.

Figure 10:
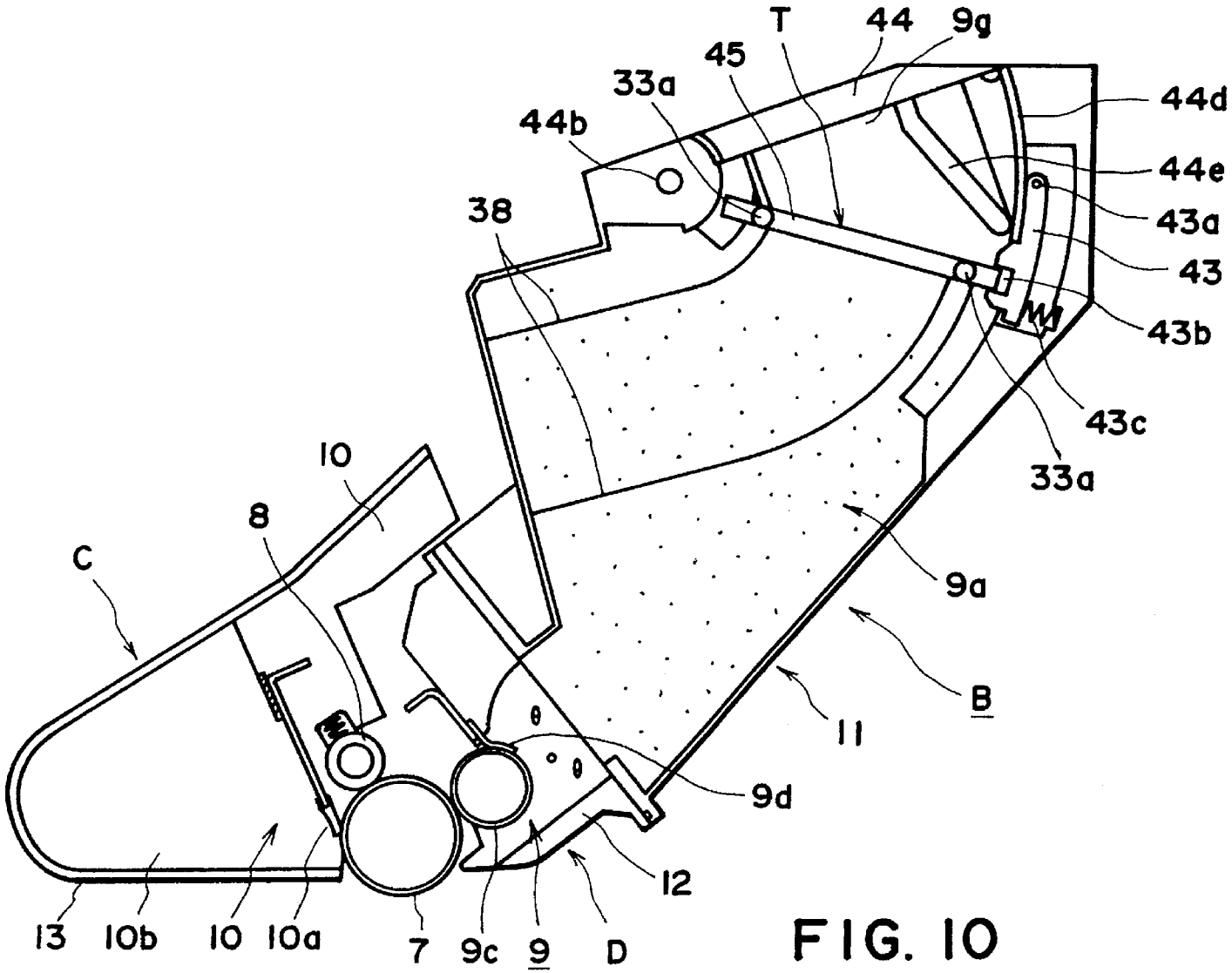
FIG. 10 is an explanatory drawing depicting the initial state of the process cartridge.

Referring to FIG. 10, a second engagement claw 43 is rotatively mounted on the inward facing surface of the rear portion of the toner storing portion 9*a*. The second engagement claw 43 also regulates, along with the first engagement claw 40, the movement of the inserted toner cartridge T. One end of the second engagement claw 43 is pivotally supported by an axial member 43*a*, and the inward side of the other end is provided with a recessed engagement portion 43*b*. On the back surface of the engagement portion 43*b*, a spring 43*c* is mounted to press inward the engagement portion 43*b*.

Further, adjacent to the opening 9*g* of the toner storing portion 9*a*, a shield plate 45 is located. This shield plate 45 keeps sealed the toner initially stored within the process cartridge B, that is, the toner is kept sealed when the process cartridge B has never been used. The shield plate 45 is fixed by the first and second engagement claws 40 and 43. It has a structure equivalent to that of the top guide plate 24, except for the lack of the insertion handle 31 and the guide hole 32.

The toner stored within the toner storing portion 9*a* never leaks out because it is sealed by the shield plate 45 and the sealing member 37 bonded to the front, rear, left, and right walls of the toner storing portion 9*a*. Further, with the presence of the shield plate 45, foreign matter, dust, or the like, is prevented from mixing into the toner through the opening during the toner refilling operation.

It should be noted here that the shield plate 45 is provided with guide rollers 33*a* at each lateral edge, and can be moved inward of the toner storing portion 9*a* by breaking its engagement with the first and second engagement claws 40 and 43, and moving the guide rollers 33*a* along the guide grooves 38 provided on the side walls of the toner storing portion 9*a*.

Next, the toner refill related operations of the process cartridge B and the toner cartridge T, which are structured as described above, will be described.

Referring to FIG. 10, when the process cartridge B is a new process cartridge, its internal space (internal space of the toner storing portion 9*a*) is full of toner, and the opening of the toner storing portion 9*a* is shielded with the shield plate 45 at a location D, that is, a location adjacent to the opening of the lower storing portion 9*a*. The process cartridge B in this state is inserted into the image forming apparatus main assembly A, and is subjected to an image forming operation, during which the initial toner supply within the process cartridge B is consumed.

Figure 11:
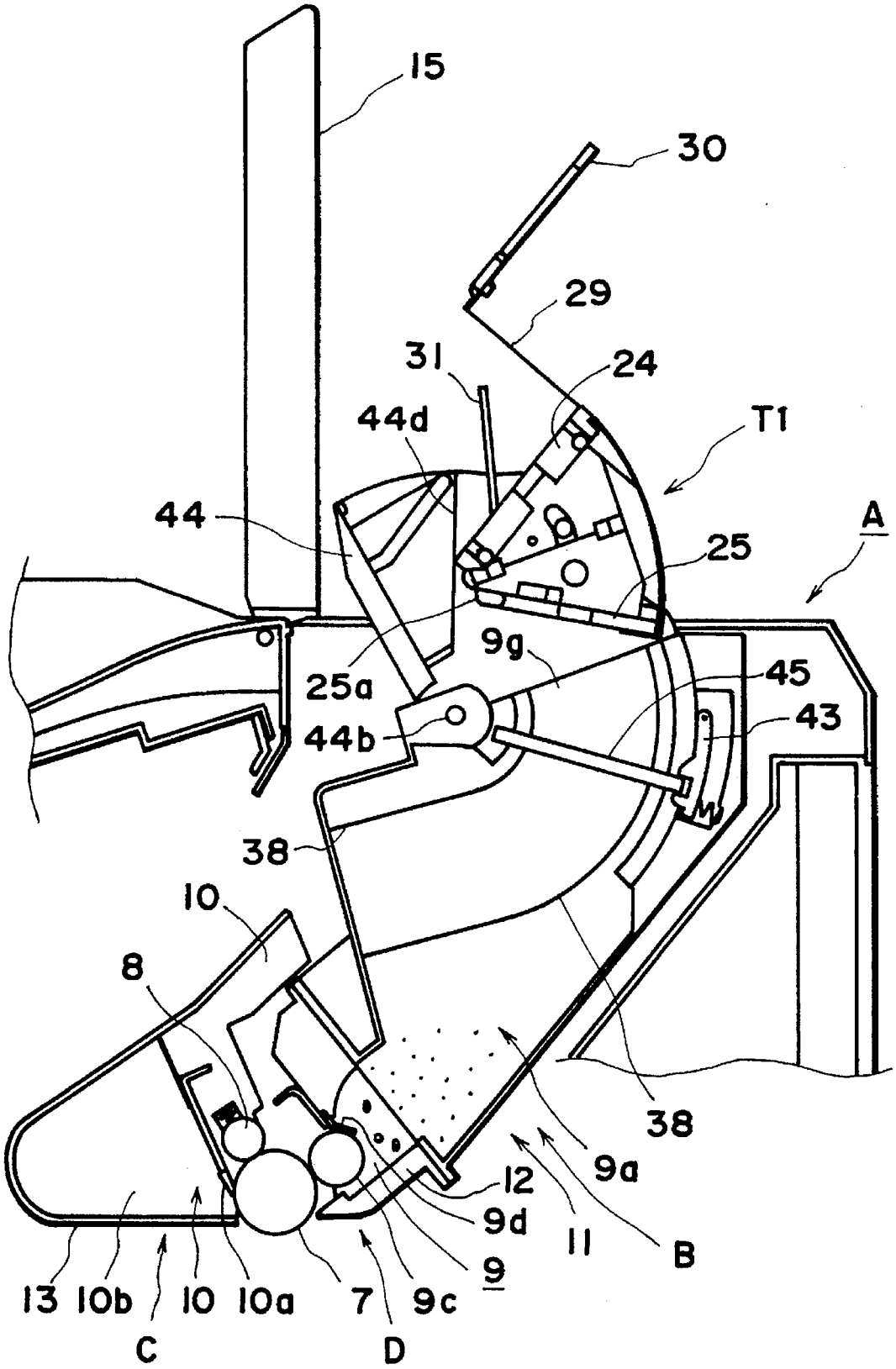
FIG. 11 is an explanatory drawing depicting how the first toner cartridge is inserted into the process cartridge.

Next, referring to FIG. 11, a case in which the toner is refilled into the process cartridge B for the first time using a toner cartridge T (first toner cartridge T1) after the toner within the toner storing portion 9*a* has been depleted as a result of the image forming operation, will be described.

First, the lid 15 of the image forming apparatus main assembly A is opened and the cover member 44 of the process cartridge B is exposed. Next, the cover member 44 is rotated about the axial projection 44*b*, exposing the opening 9*g* of the toner storing portion 9*a*. In this state, an operator grasps the insertion handle 31 of the first toner cartridge T1, moves the first toner cartridge T1 to the location above the opening of the toner storing portion 9*a*, and places the first toner cartridge T1 into the opening 9*g*.

At this point, the first toner cartridge T1 is oriented so that the vertex of the first toner cartridge T1, with reference to its section, is located on the axial projection 44*b* of the cover member 44, and the bottom guide plate 25 faces the shield plate 45. Also at this point, the projection 25*a* projecting from the surface of the longitudinal end of the bottom guide wall 25 is engaged with the top guide groove 38 of the toner storing portion 9*a*.

The size of the bottom guide plate 25 of the first toner cartridge T1 is set up to be smaller than the size of the opening surrounded by the sealing members 37 bonded on the lateral walls, the front wall, and the rear wall, of the toner storing portion 9*a*. On the other hand, the size of the top guide plate 24 is set up to be larger than the size of the opening surrounded by the sealing members 37 bonded on the lateral walls, the front wall, and the rear wall, of the toner storing portion 9*a*, but smaller than the size of the opening of the toner storing portion 9*a* before the sealing member 37 is attached. Therefore, as the first toner cartridge T1 is inserted through the opening 9*g*, the bottom guide plate 25 is allowed to pass through the opening 9*g*, but the top guide plate 24 is stopped as it reaches the opening 9*g*.

In this state, the tear tape handle 30 of the first toner cartridge T1 extends away from the toner storing portion 9*a* because it is held by the tear tape handle fixing plate 29 so as to project from the cartridge T1.

Next, the cover member 44 is rotated in the closing direction, whereby the pusher projection 44*d* of the cover member 44 is placed in contact with the top surface of the top guide plate 24 of the first toner cartridge T1. As the cover member 44 is further rotated in the closing direction, the first toner cartridge T1 is pushed into the process cartridge B following the guide grooves 38, with the sealing member 37 being compressed between the periphery of the top guide plate 24, and the lateral, front and rear walls of the toner storing portion 9*a*.

In this state, immediately before the top surface of the shield 45 comes in contact with the bottom surface of the bottom Guide plate 25 of the first toner cartridge T1, the first projecting portion 40*b* of the first engagement claw 40 provided on the outward facing surface of the side wall of the toner storing portion 9*a* is pressed, along with the curtain 42, by the inward facing surface of the side plate 44*a* of the cover member 44, as illustrated in FIG. 9, whereby the first engagement claw 40 is rotated counterclockwise in the drawing about the axial member 40, breaking the engagement between the first engagement claw 40 and the shield plate 45.

Figure 12:
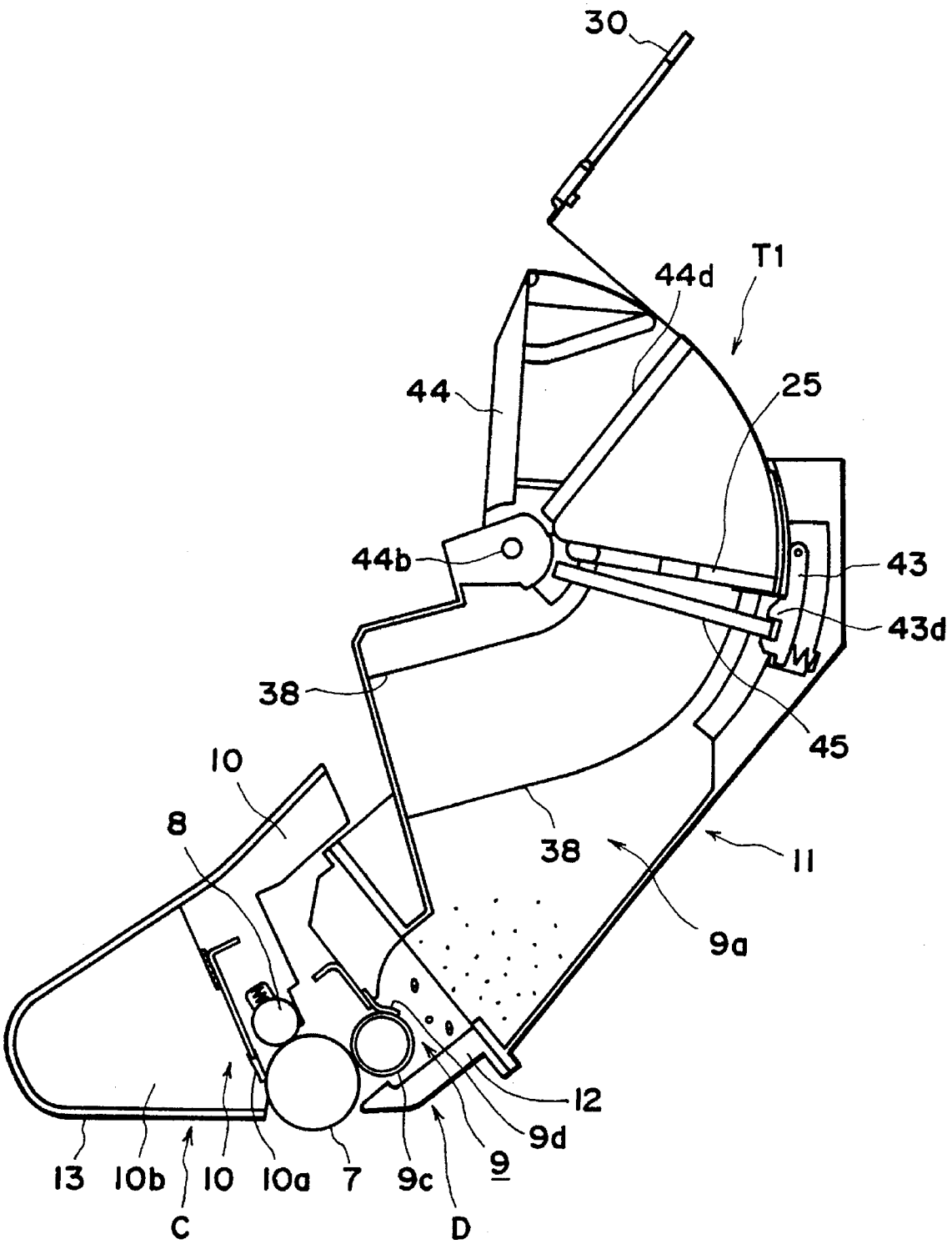
FIG. 12 is an explanatory drawing depicting how the first toner cartridge is positioned at the opening of the process cartridge.

At the same time, the projection 43*d* of the second engagement claw 43 provided at the top portion of the rear wall of the toner storing portion 9*a* is pressed by the edge portion of the bottom guide plate 25 of the first toner cartridge T1 as illustrated in FIG. 12, whereby the second engagement claw 43 is rotated counterclockwise in the drawing about the axial member 43 against the pressure from the spring 43*c*. As a result, the edge portion of the shield plate 45 is disengaged from the recessed engagement portion 43*b*, breaking the engagement between the second engagement claw 43 and the shield plate 45.

Thereafter, the first toner cartridge T1 is further inserted, with the guide rollers 33 of the top guide plate 24 being engaged with the correspondent guide grooves 38 of the toner storing portion 9*a*. As a result, the shield plate 45 is moved inward of the toner storing portion 9*a* while remaining flatly in contact with the bottom guide plate 24 of the first toner cartridge T1.

Figure 13:
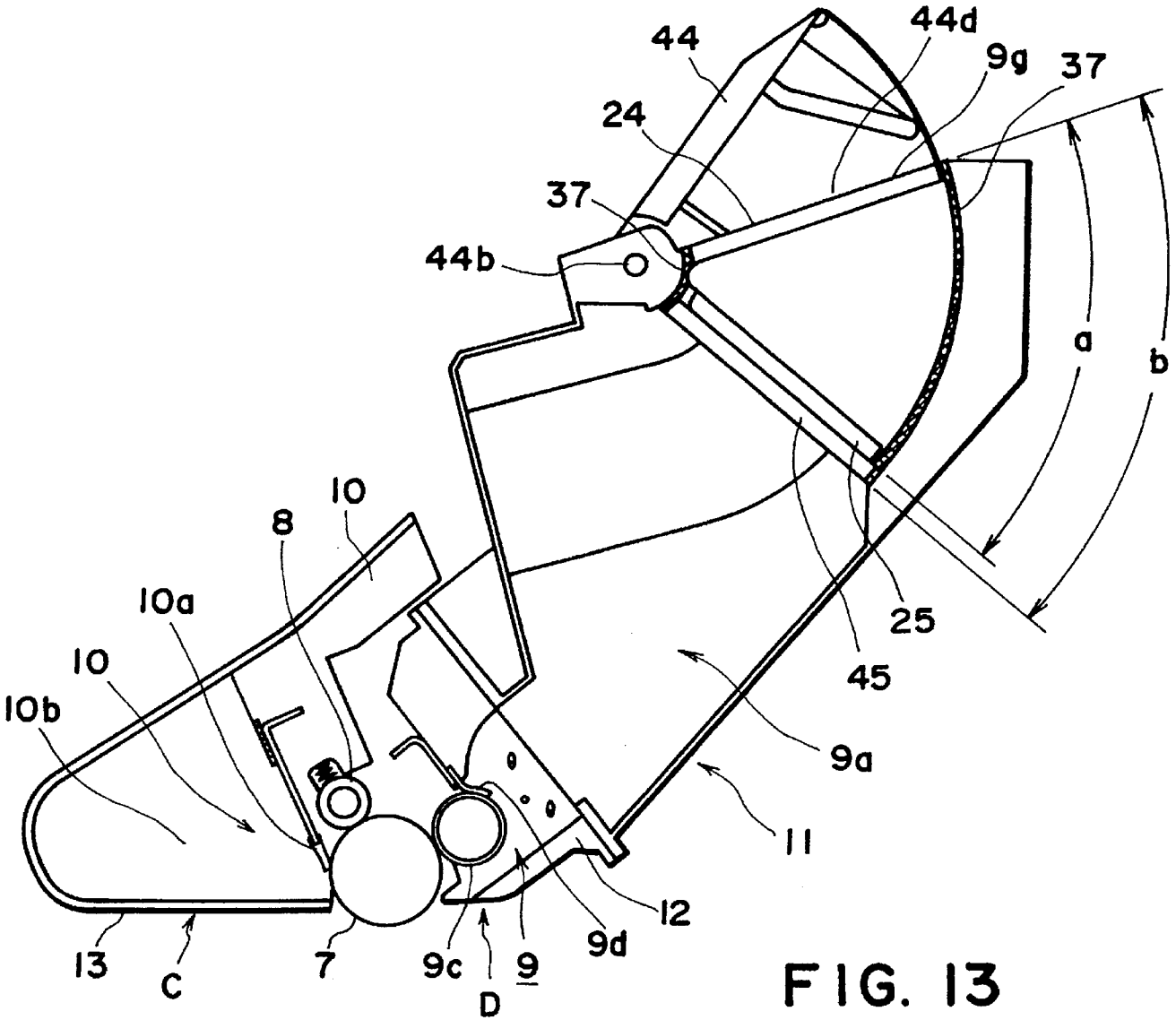
FIG. 13 is an explanatory drawing depicting how the process cartridge is sealed.

Referring to FIG. 13, before the shield plate 45 being moved inward of the toner storing portion 9*a* along with the first toner cartridge T1 comes out of the sealing member region in which the shield plate 45 remains in contact with the sealing members 37 bonded to the lateral, front, and rear walls of the toner storing portion 9*a,* the top guide plate 24 of the first toner cartridge T1 comes in contact with the sealing member 37 bonded to the lateral, front, and rear walls of the toner storing portion 9*a;* therefore, the sealed state of the toner storing portion 9*a* is not interrupted. More specifically, the sealing member 37 is bonded on the lateral, front, and rear walls of the toner storing portion 9*a* so as to cover inwardly from the opening of the toner storing portion 9*a* far enough to seal the edge of the shield plate 45, which is flatly in contact with the bottom guide plate 25 of the first toner cartridge T1. Further, when the first toner cartridge T1 having been inserted through the opening 9*g* is in the state illustrated in FIG. 13, an arc b connecting the top surface of the top guide plate 24 and the bottom surface of the shield plate 45 is larger than an arc connecting the top surface of the top guide plate 24 and the bottom surface of the bottom guide plate 25. Therefore, the sealed state of the toner storing portion 9*a* can be maintained.

Figure 14:
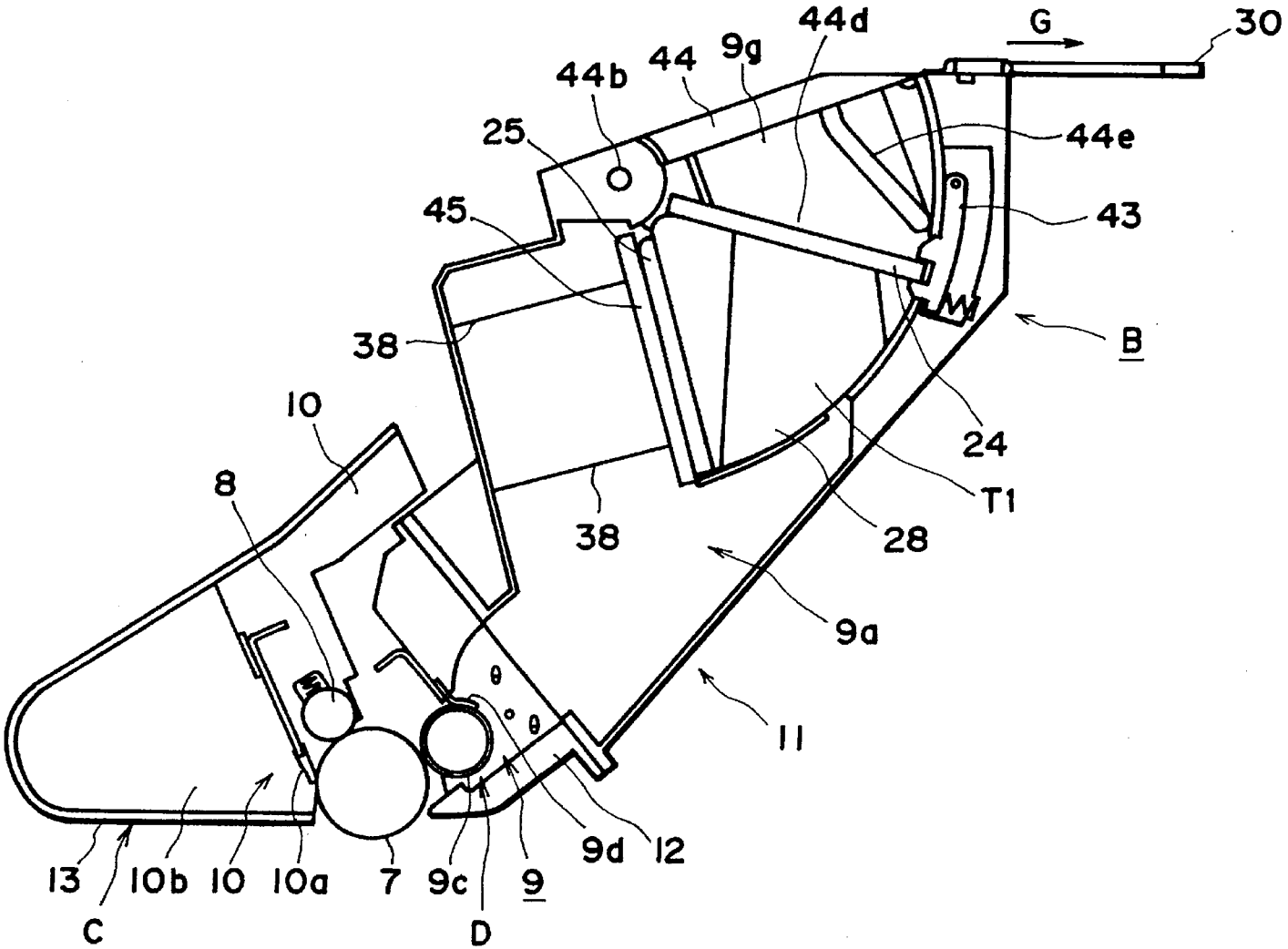
FIG. 14 is an explanatory drawing depicting a state in which the first toner cartridge is at a predetermined location within the process cartridge.

Next, the cover member 44 is completely shut as shown in FIG. 14. Regarding this state, the height of the pusher projection 44*d* of the cover member 44 is such that when the cover member 44 is completely shut, the pusher projection 44 causes the top guide plate 24 to engage with the first engagement claw 40 (FIG. 9) and the second engagement claw 43, stopping the first toner cartridge T1 at a spot at which the opening portion of the first toner cartridge T1 faces downward to allow the toner to be easily discharged.

Figure 15:
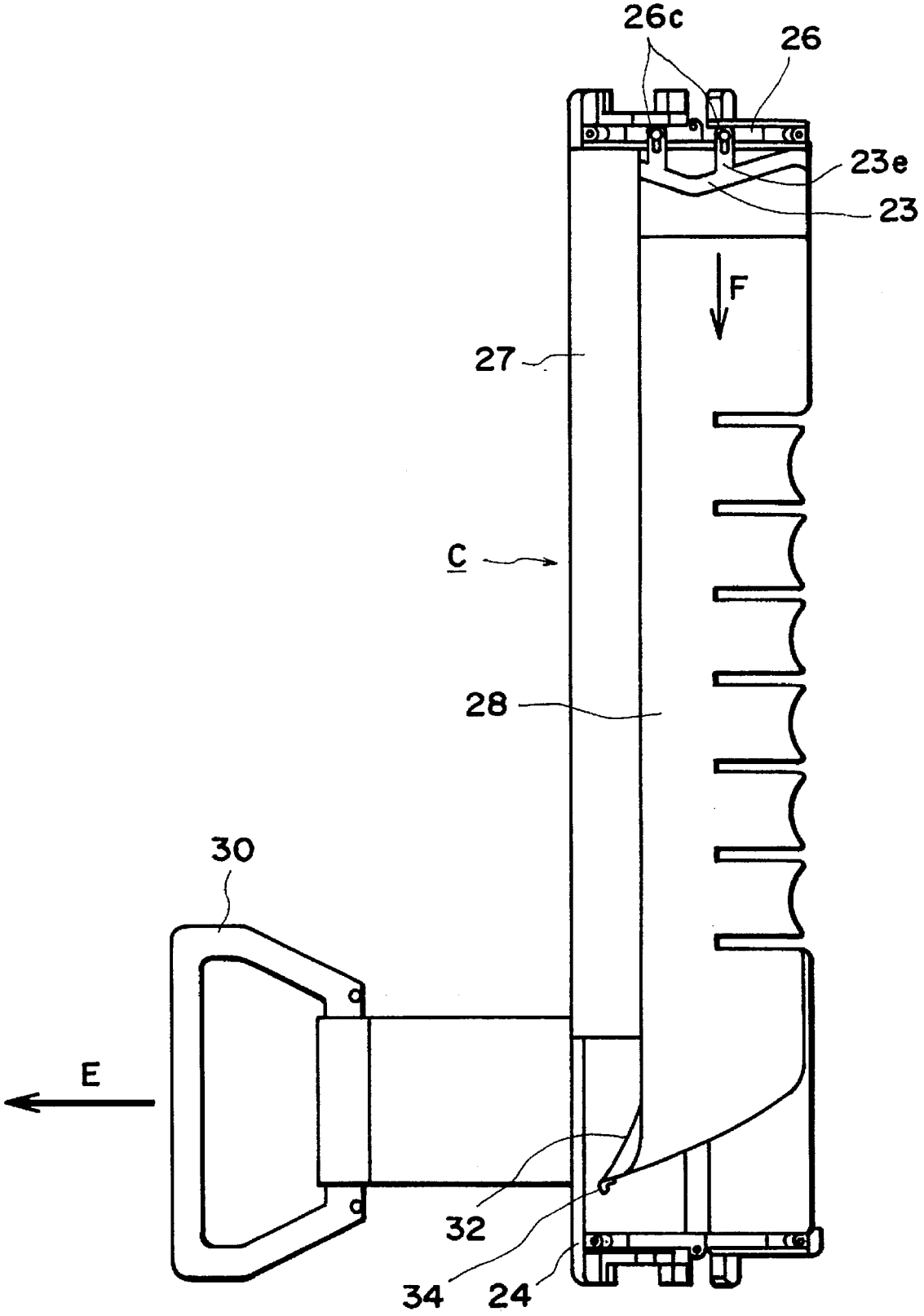
FIG. 15 is an explanatory drawing depicting how the tear tape of the first toner cartridge is removed from the toner cartridge positioned as depicted in FIG. 14.

In this state, the tear tape handle 30 is pulled in the direction indicated by an arrow mark E in FIG. 15, that is, in the direction perpendicular to the longitudinal direction of the toner storing container 23, whereby the tear tape 28 is pulled in the direction indicated by an arrow mark F, that is, it is moved in the longitudinal direction of the toner storing container 23, tearing the cover film 27 sealing the toner storing container 23, along the tear line 27*a,* peeling off the bonded portion of the cover film 27, and allowing the toner to discharge from the first toner cartridge T1.

However, the flexible toner storing container 23 does not move together with the tear tape 28 as the tear tape 28 is pulled because a hooking portion 23*e* of the toner storing container 23 is hooked on the projection 26*e* of the side plate 26, and the side plate 26 is fixed by the stopper 36, which will be described later.

The tear tape 28 is folded back through the guide hole 32, and as it is pulled, the toner adhering to the surface of the tear tape 28 is dropped into the toner storing container 9*a* by the wiping seal 34. The guide hole 32 is arc-shaped; therefore, the force applied to pull the tear tape 28 in the direction of an arrow mark E is caused to work to move the tear tape 28 toward the center portion of the guide hole 32, preventing the tear tape 28 from displaced to one side of the guide hole 32. Therefore, the occurrence of the wrinkling of the tear tape 28, which prevents smooth removal of the tear tape 28, can be prevented.

Figure 16:
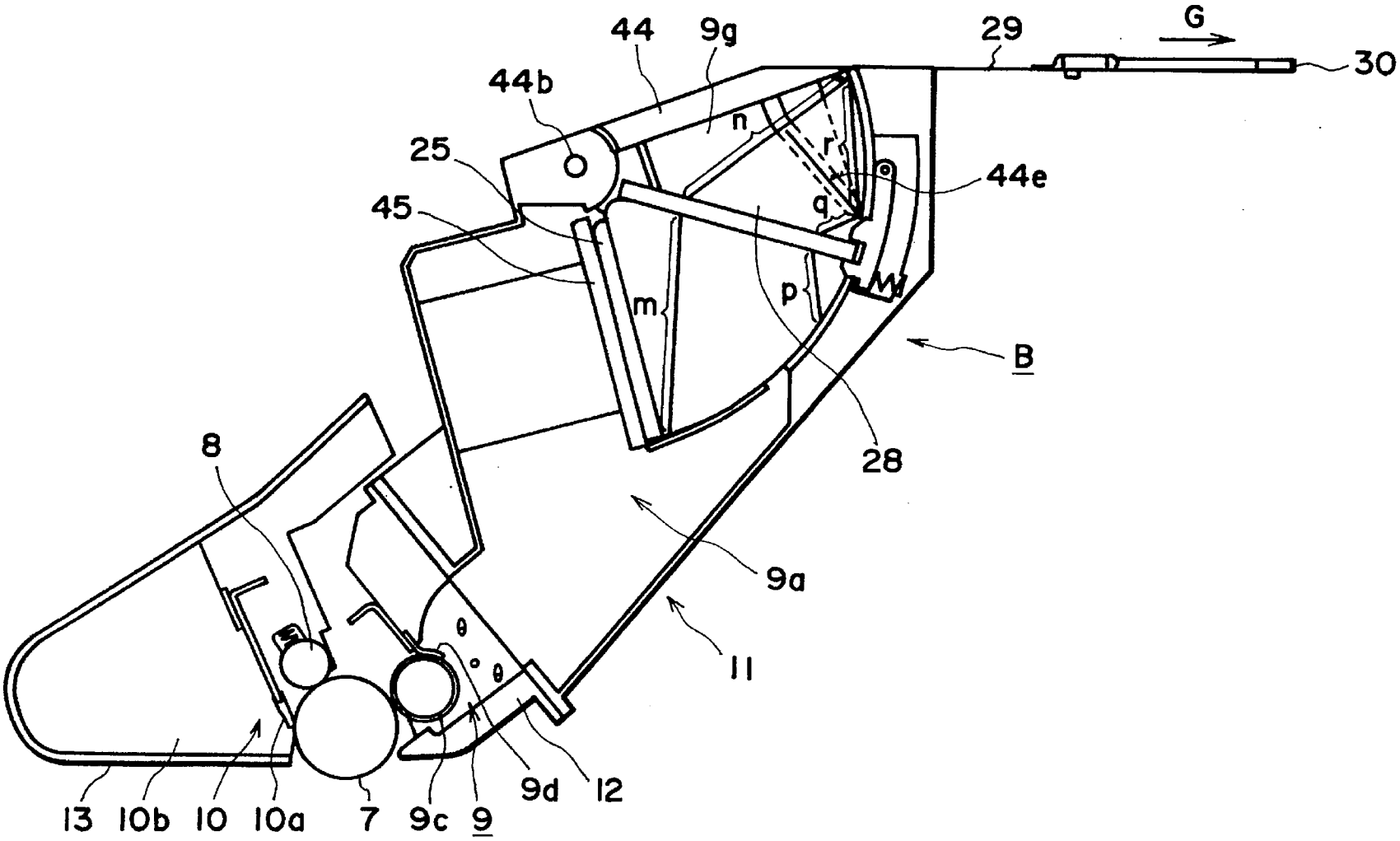
FIG. 16 is an explanatory drawing depicting how the tear tape illustrated in FIG. 15 is removed.

Next, referring to FIG. 16, the tear tape 28 is folded back at the guide rib 44*e* of the cover member 44, changing the direction toward the pull-out direction G. Since the guide hole 32 (FIG. 15) and the guide rib 44*e* are formed so that the length m-n, including the portion sticking out of the cover member 44, of one longitudinal edge of the tear tape 28 becomes substantially the same as the length p-g-r, including the portion sticking out of the cover member 44, of the other longitudinal edge of the tear tape 28, the tear tape 28 can be pulled out in the direction perpendicular to the longitudinal direction of the process cartridge B.

The above structure allows the tear tape 28 to be pulled out with the cover member 44 of the process cartridge B closed; therefore, the toner refilling operation can be easily and smoothly carried out.

Thereafter, the lid 15 of the image forming apparatus main assembly 14 is closed. Thus, the toner is refilled into the process cartridge B to restart the image forming operation.

Next, a case in which the toner refilled by the first toner cartridge T1 also has been depleted, and toner is refilled a second time using another toner cartridge (second toner cartridge T2) will be described.

Figure 17:
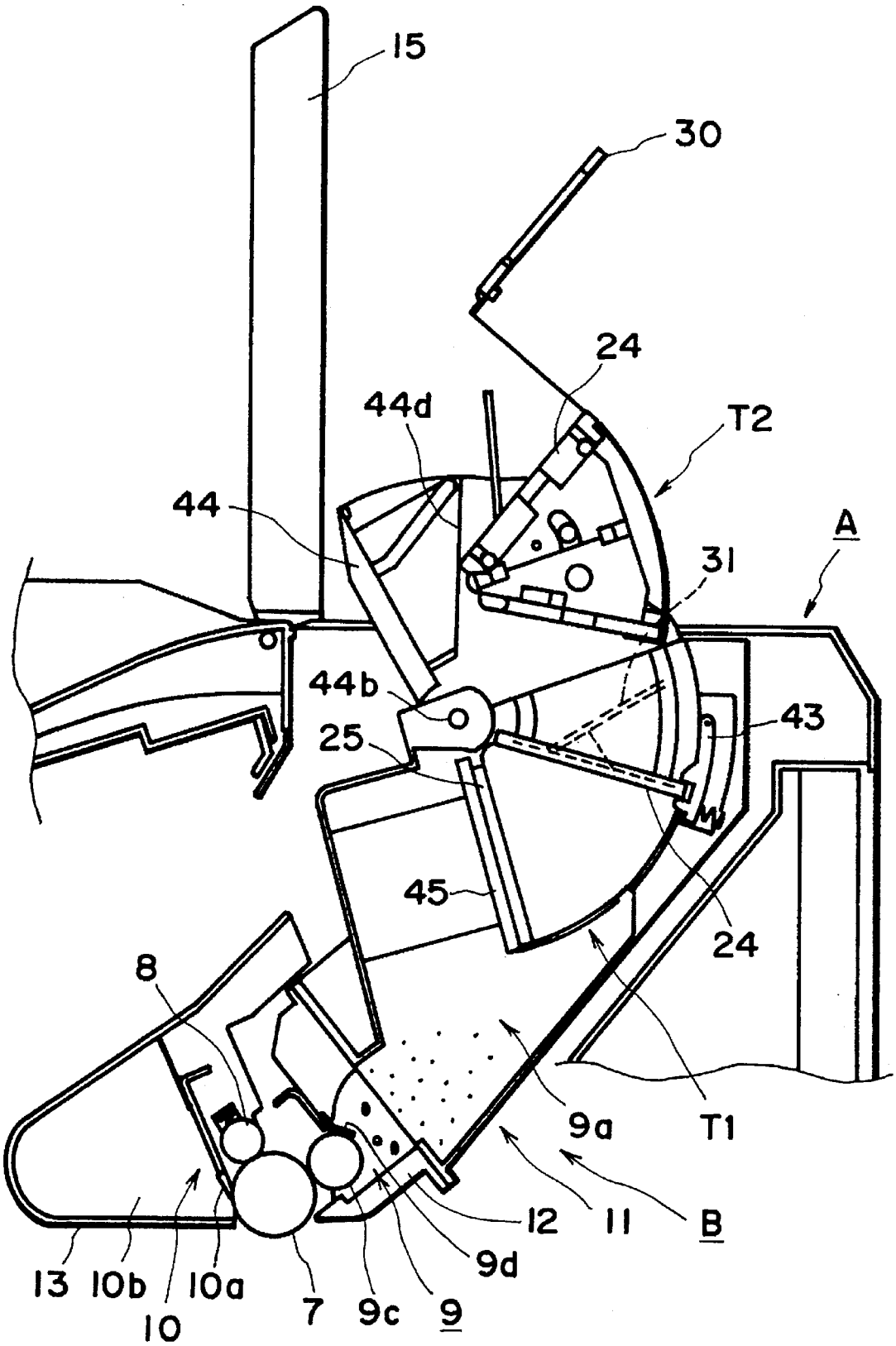
FIG. 17 is an explanatory drawing depicting how the second toner cartridge is inserted into the process cartridge.

Referring to FIG. 17, first, the lid 15 of the image forming apparatus main assembly A is opened. Then, the cover member 44 of the process cartridge B is rotated in the opening direction, exposing the opening of the toner storing portion 9*a*. Next, the second toner cartridge T2 is inserted into the toner storing portion 9*a* in the same manner as the first toner cartridge T1. Then, the cover member 44 is rotated in the direction of the arrow mark in the same manner as in the case of the first toner cartridge T1, whereby the top surface of the top guide plate 24 of the second toner cartridge T2 is pressed inward of the toner storing portion 9*a* by the pusher projection 44*d* of the cover member 44.

At this point, the engagement of the first toner cartridge T1 with the first engagement claw 40 and the second engagement claw 43 is broken in the same manner as when the first toner cartridge T1 is inserted into the toner storing portion 9*a*. As a result, the first and second toner cartridges T1 and T2 move together. The insertion handle 31 provided on the top surface of the top guide plate 24 of the first toner cartridge T1 is forced into the recess 24*a* (FIG. 1) of the top guide plate 24. Therefore, the top surface of the top guide plate 24 becomes flat.

Next, the bottom guide plate 25 passes by the spring 39 (FIG. 8) provided on the lateral walls of the toner storing portion 9*a,* without interfering with the spring 39, which is possible because the bottom guide plate 25 is provided with the cutaway portion 25*b* (FIG. 1). Then, the projection 36*b* of the stopper 36 provided on the side plate 26 of the toner cartridge T1 comes in contact with the spring 39.

Figure 18:
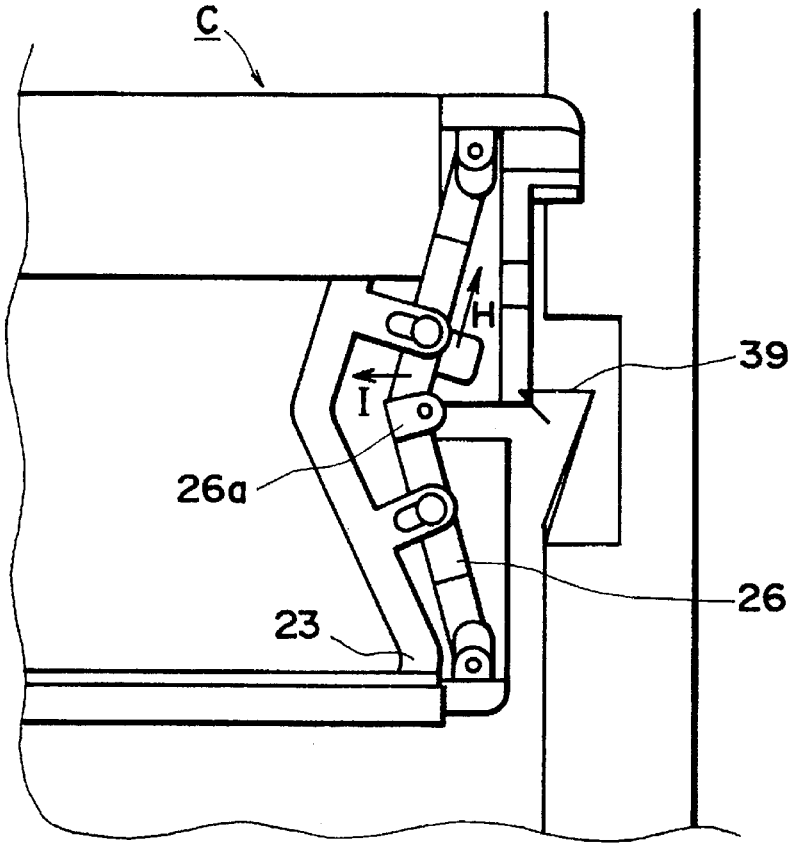
FIG. 18 is an explanatory drawing depicting the relationship between the first toner cartridge and the spring member of the process cartridge.
Figure 19:
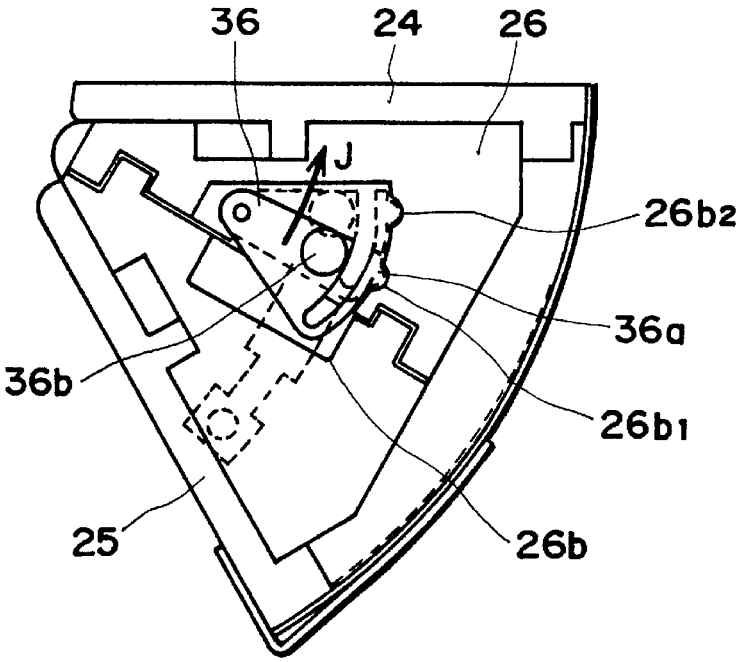
FIG. 19 is an explanatory drawing depicting the function of the stopper of the first toner cartridge.
Figure 20:
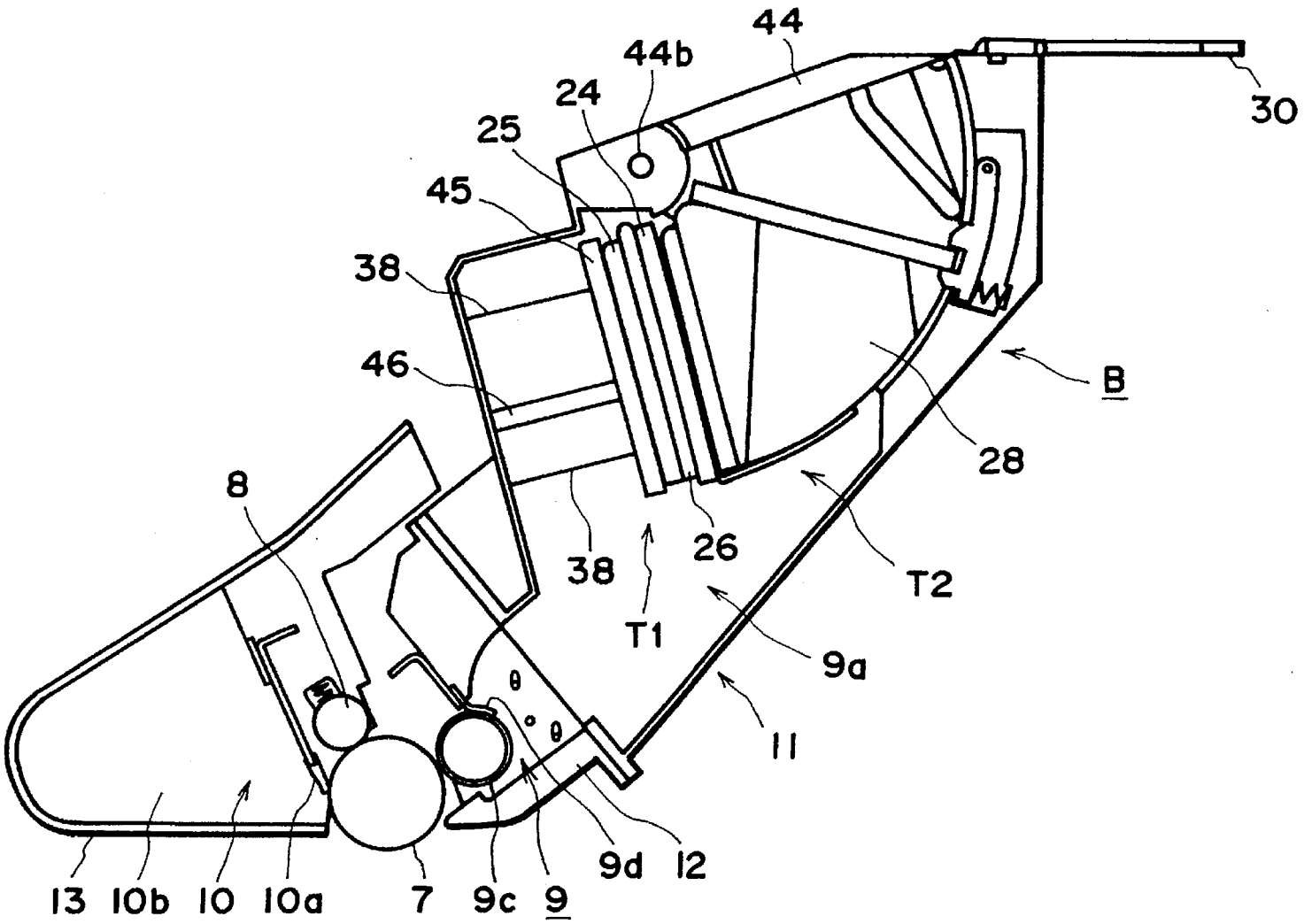
FIG. 20 is an explanatory drawing depicting a state in which the second toner cartridge is at a predetermined location in the process cartridge.

At this moment, the stopper 36 receives the force from the spring 39 in the direction of an arrow mark H as shown in FIGS. 18 and 19. The stopper 36 has been held immobile within the slit 26 as the claw 36*a* of the stopper 36 meshes with the first recess 26*c* of the slit 26*b* (solid line), but upon receiving the force from the spring 39, it is moved in the direction of an arrow mark J, whereby the claw 36*a* engages with the second recess 26*d,* holding the stopper 36 there (dotted line). As a result, the side plate 26 is rendered foldable as soon as the trailing end of the moving stopper 36 passes the folding line.

Further, the projection 3*b* of the stopper 36 receives the force from the spring member 39 also in the direction of an arrow mark I; therefore, the side plate 26 is folded inward at the hinge portion 26*a*. In this state, the first toner cartridge T1 has already discharged the toner from the toner storing container 23, allowing the side plate 26 to be easily folded without any interference. As the side plate 26 is folded inward, the projection 3*b* of the stopper 36 loosely fits in to the correspondingly drilled hole 26*d* (FIG. 1). As a result, the folding of the side plate 26 is not disrupted due to the interference between the projection 36*b* and the side plate 26.

Thereafter, the top guide plate 24 passes by the spring member 39 without interference, which is rendered possible because the top guide plate 24 is provided with the cutaway portion 24b (FIG. 1). Then, the folded first toner cartridge T1 is moved from the region in which the guide grooves 39 form concentric arcs, to the region in which the guide grooves 38 form parallel straight lines. As a result, the top guide plate 24 and the bottom guide plate 26 become parallel, reducing the volume of the folded first toner cartridge T1 to a minimum. It should be noted here that even when vibrations or the like unexpectedly occur during the folding of the side plate 26, a rib 46 disposed on the inward facing surface of the lateral wall of the toner storing portion 9a in parallel to the guide groove 38 regulates the movement of the projection 36b of the stopper 36; therefore, the side plate 26 which has already begun to be folded does not return to its initial state.

Next, toner is released into the process cartridge B by pulling out the tear tape 28 of the second toner cartridge T2 in the same manner as in the case of the first toner cartridge T1, and then, the lid 15 of the image forming apparatus main assembly A is closed to restart the image forming operation.

Figure 21:
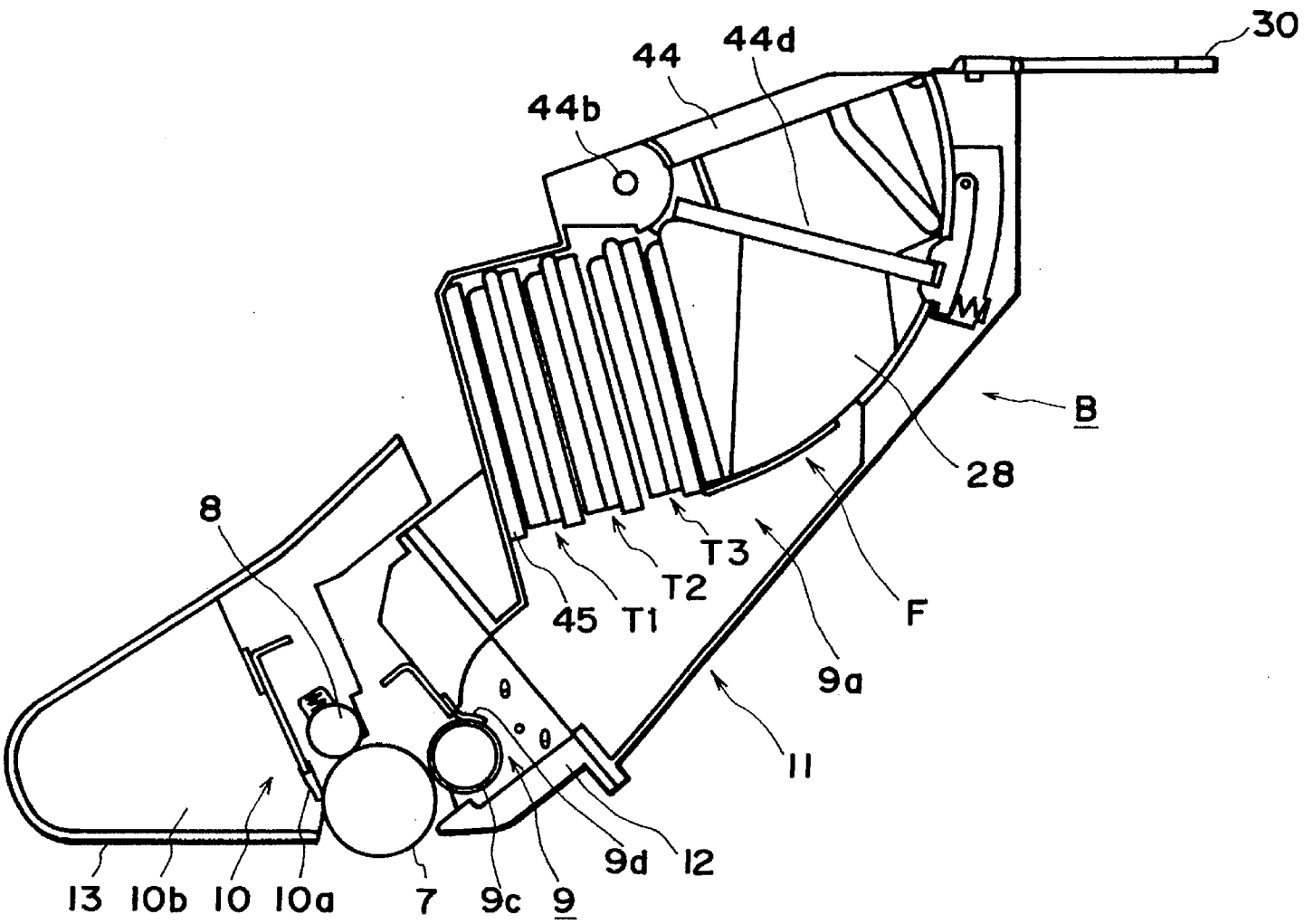
FIG. 21 is an explanatory drawing depicting a state in which the first to fourth toner cartridges are in the process cartridge.

Thereafter, each time the refilled toner is depleted, fresh toner can be supplied by inserting a new toner cartridge. The preceding toner cartridges are sequentially pushed inward and accumulated as a new cartridge is inserted. In this embodiment, up to four toner cartridges T1, T2, T3 and T4 can be inserted as shown in FIG. 21.

As described above, the toner cartridge in accordance with the present invention is foldable to reduce its volume to a minimum, saving space. Therefore, the toner cartridge in accordance with the present invention can increase the number of toner cartridges insertable in the toner storing portion 9a, which in turn increases the amount of refillable toner. In addition, it allows new toner cartridges to be inserted in succession without a need for removing the preceding one. Therefore, it makes the toner refilling operation a simple and easily understandable operation, preventing the scattering of the toner. Further, the sealing member having a proper thickness is bonded to the inward facing surface of the front, rear, and lateral walls of the toner storing portion 9a, making it possible to reliably prevent toner leakage.

Further, according to the present invention, the toner cartridge is given a substantially triangular cross section, and is pushed into the process cartridge following the arc-shaped guide. Also, it is deformed to give it a rectangular cross section having a smaller size than the initial triangular cross section, and is accumulated along the parallel guides. Therefore, the apparatus can be downsized.

Further, one of the surfaces of the toner cartridge in the form of a triangular column, where the toner cartridge is to be unsealed to discharge the toner into the toner storing portion, is oriented downward as the toner cartridge is inserted following the insertion path within the toner hopper. Therefore, the toner within the toner storing container can be reliably discharged.

Embodiment 2

Next, another type of a toner cartridge T mounted in the process cartridge B in accordance with the present invention will be described with reference to FIGS. 30–33. Regarding the description of this embodiment, only the portions different from those of the toner cartridge T described in the first embodiment will be described. The portions identical to the those in the preceding embodiment will be given identical reference numerals to omit their descriptions.

Figure 30:
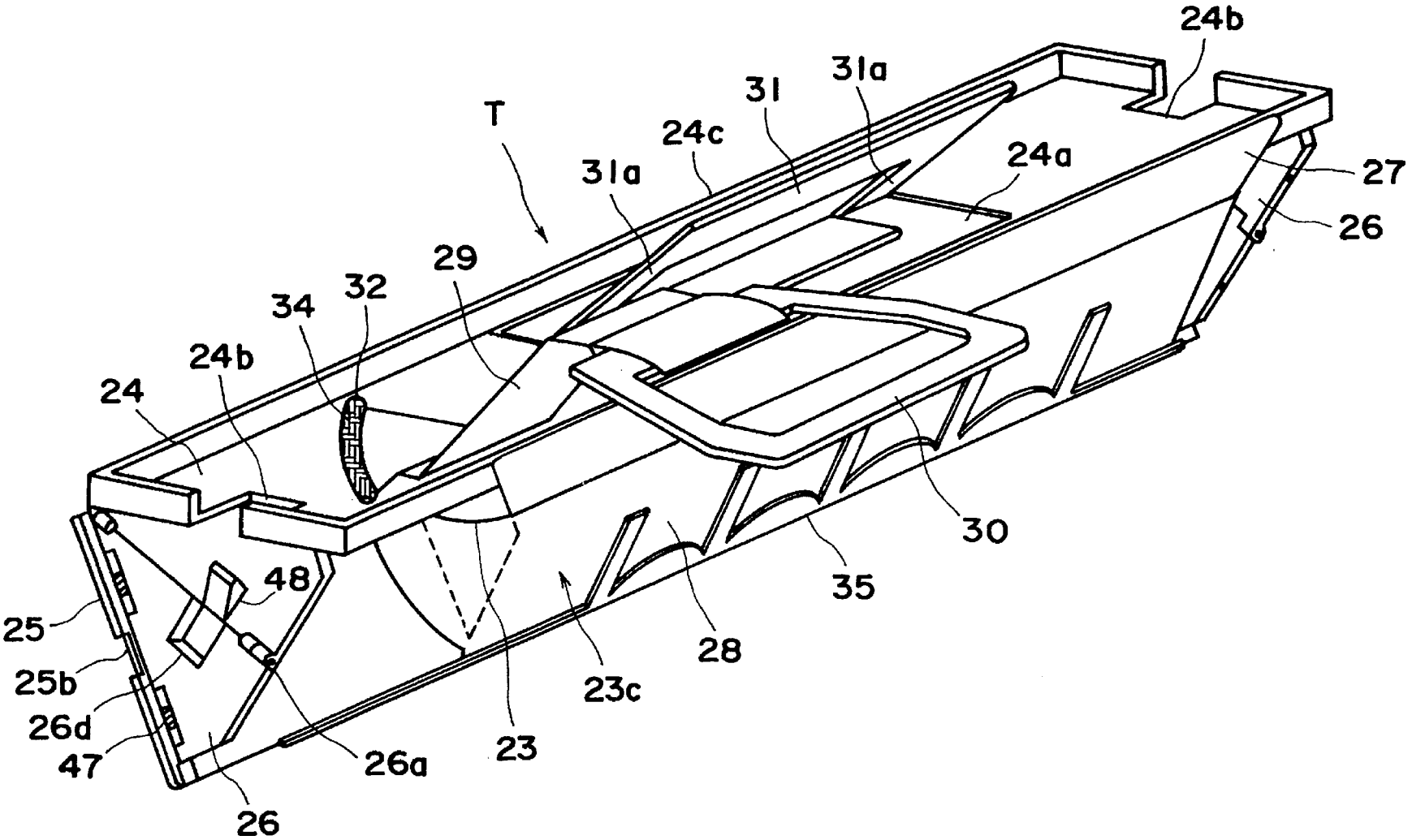
FIG. 30 is a perspective view of the toner cartridge in the second embodiment of the present invention.
Figure 31:
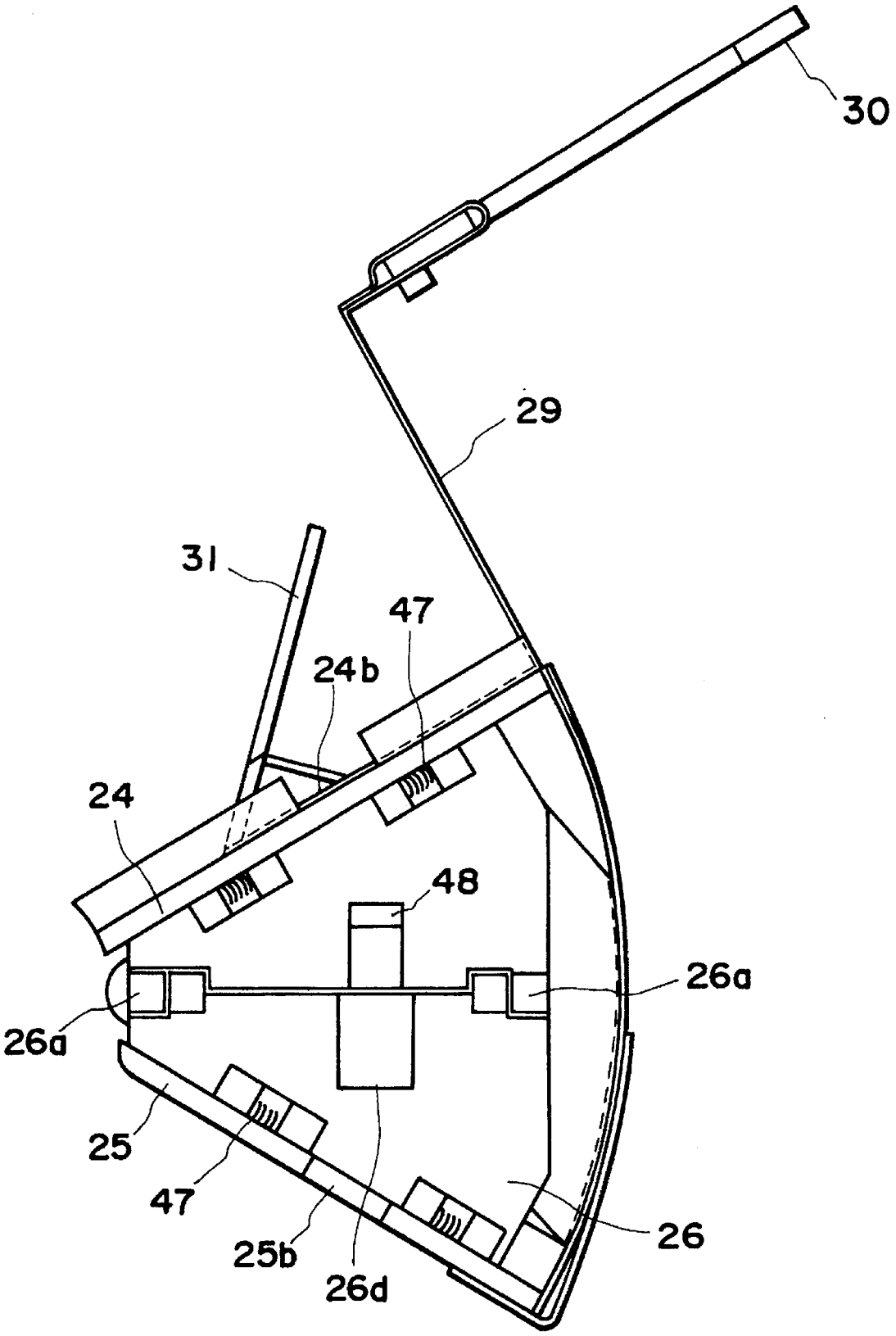
FIG. 31 is a sectional view of the toner cartridge illustrated in FIG. 30.

Referring to FIGS. 30 and 31, the toner cartridge T in this embodiment has a rib 24c which is erected from the periphery of the top guide plate 24 of the toner cartridge T. In order to keep sealed the toner contained in the toner storing portion 9a, it is preferable that this rib 24c has a proper height for providing a sufficiently wide contact area between the toner cartridge T, and the sealing member 37 bonded to the inward facing surface of the front, rear, and lateral walls which surround the toner storing portion 9a of the process cartridge B. Also, it is preferable that the rib 24c has a proper height for enabling the bottom guide plate 25 of one toner cartridge T to be fitted within the space surrounded by the rib 24c of another toner cartridge T, and for sufficiently reinforcing the top guide plate 24.

Each longitudinal end of the top guide plate 24 is provided with a cutaway portion 24b. The cutaway portion 24b is located at a substantially middle portion of the edge, and prevents the rib 46 of the process cartridge B, which will be described later, from interfering with the top guide plate 24. The bottom guide plate 25 is also provided with cutaway portions 25b similar to the cutaway portion 24b.

Referring to FIG. 31, a spring 47, that is, an elastic member, is disposed at the joints between the top and bottom guide plates 24 and 25, and the side plate 26, pressing outward the side plate 26. This arrangement prevents the side plate 26 from folding inward, by resisting the force which normally works to fold the top and bottom guide plates 24 and 25 toward each other.

The top guide plate 24 side and half of the side plate 26 is provided with a projection 48. The projection 48 is located at a location correspondent to the mid portion of the hinge portion 26a. Its configuration is such that its height increases from the hinge portion 26a toward the top guide plate 24. Corresponding to the projection 48, the bottom guide plate 25 side half of the side plate 26 is provided with a hole 26d. The projection 48 is moved inward toward the hole 26d as it is contacted by the rib 46 of the process cartridge B, which will be described later. As a result, the side plate 26 becomes foldable.

The toner cartridge in this embodiment is simpler since it does not comprise the guide rollers 33 of the top guide plate 24, the projection 25a of the bottom guide roller 25, and the stopper 36 of the side plate 26, with which the toner cartridge described in the first embodiment was provided.

Figure 32:
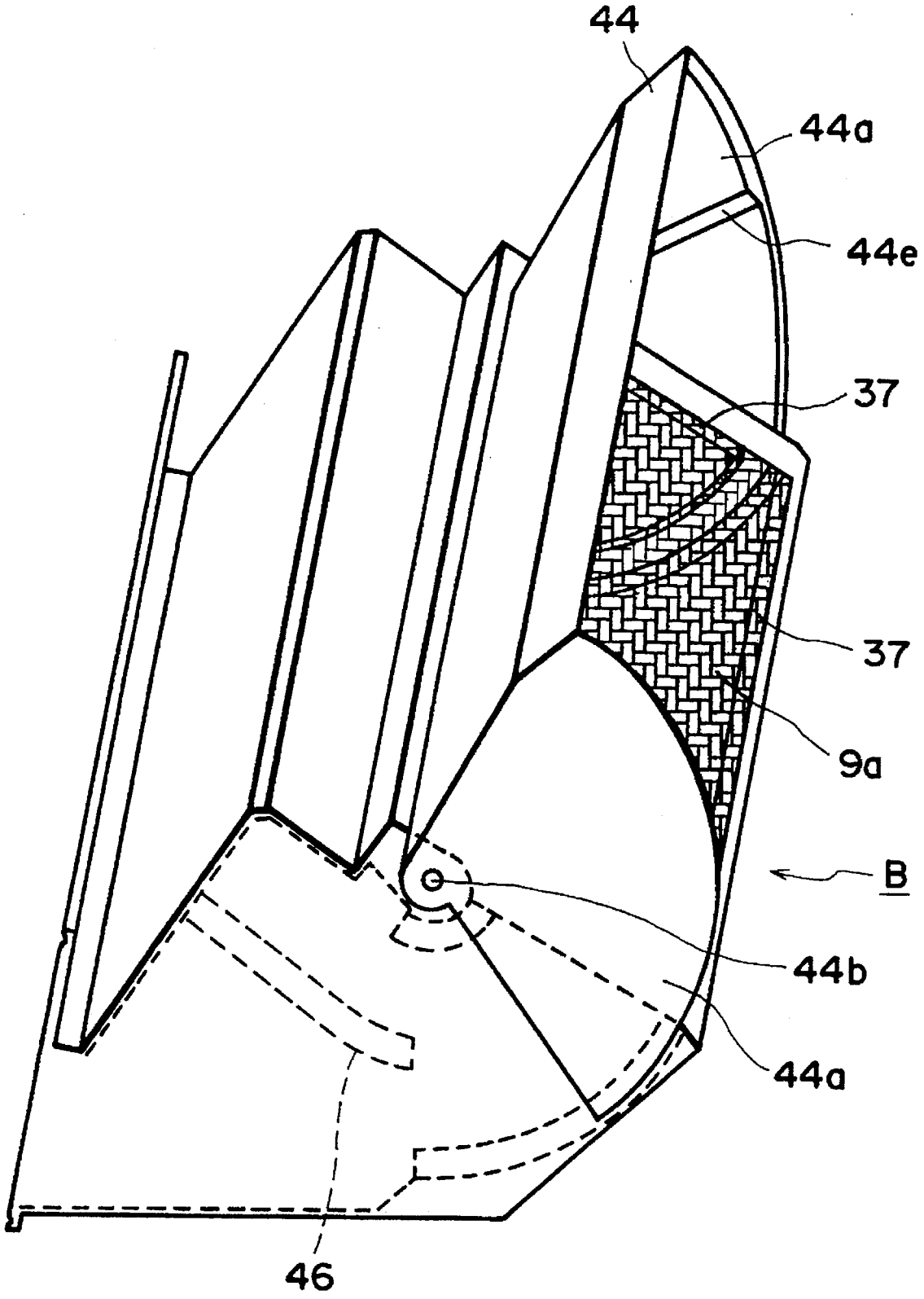
FIG. 32 is a perspective view of a process cartridge in which the toner cartridge illustrated in FIG. 30 is inserted.
Figure 33:
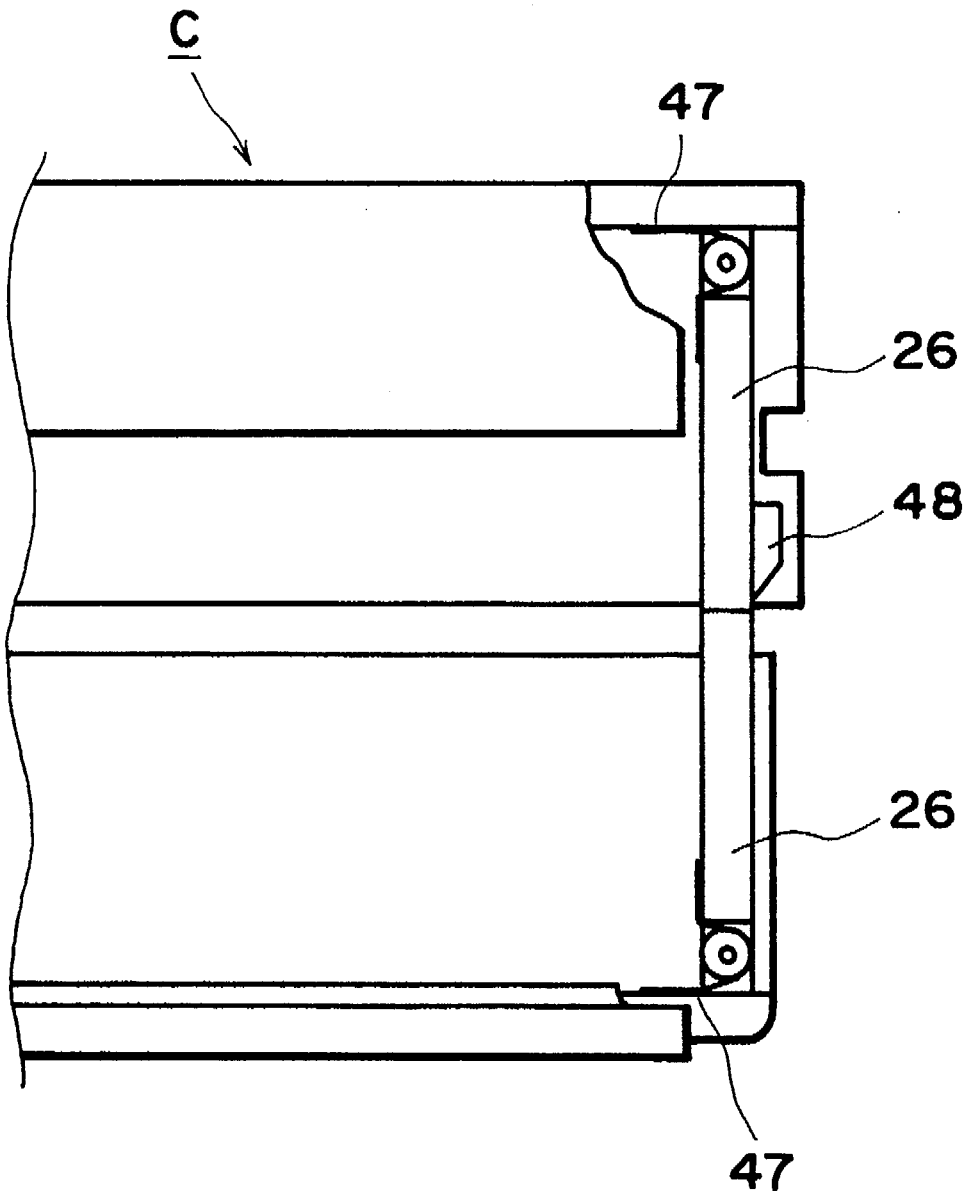
FIG. 33 is an explanatory drawing depicting the side plate of the toner cartridge illustrated in FIG. 30.

Further, the process cartridge in this embodiment does not comprise the guide groove 38 provided On the lateral walls surrounding the toner storing portion 9a for guiding the inserted toner cartridge T, or the spring 39 for folding the inserted toner cartridge T, with which the process cartridge described in the first embodiment was provided. Instead, in this embodiment, only a rib 46 capable of offering the same function as the spring 39 is provided on the lateral walls of the toner storing portion 9a, extending from the deeper end toward the entrance as illustrated in FIG. 32.

Next, a toner refilling operation, in which the process cartridge B structured as described above is refilled with the toner from the toner cartridge T described above, will be described.

The toner refilling operation in this embodiment can be carried out in the same manner as that in the first embodiment. First, the first toner cartridge T1 is placed at the opening of the toner storing portion 9a. Then, the cover member 44 is rotated in the closing direction to place the pusher projection 44d in contact with the top surface of the top guide plate 24 of the first toner cartridge T1. Thereafter, the cover member 44 is further rotated in the closing direction, whereby the first toner cartridge T1 is pushed into the toner storing portion 9a following the side walls thereof while compressing the sealing member 37 between the rib 24*c* of the top guide plate 24 and the lateral, front, and rear walls of the toner storing portion 9*a*.

After the shield plate 45 locked in the initial state is unlocked as described in the embodiment 1, the first toner cartridge T1 is pushed further into the toner storing portion 9*a*, whereby the bottom guide plate 25 of the first toner cartridge T1 is placed flatly in contact with the shield plate 45. Thereafter, the first toner cartridge T1 and the shield plate 45 are moved together further into the toner storing portion 9*a*.

Next, the cover member 44 is completely shut. Then, the tear tape handle 30 is pulled, whereby the cover film 27 sealing the toner storing container 23 is torn along the tear line 27*a*, and also, the portion of the cover film 27 bonded to the flange is peeled off, discharging toner from the first toner cartridge T1.

Finally, the lid 15 of the image forming apparatus main assembly A is closed. Thus, toner is refilled into the process cartridge B, making it possible to restart the image formation.

Next, a case in which the toner refilled by the first toner cartridge T1 has been also depleted, and toner is refilled a second time by the second toner cartridge T2 will be described.

As described before, the second toner cartridge T2 is inserted into the toner storing portion 9*a* in the same manner as the first toner cartridge T1, and then, as the cover member 44 is rotated, the top surface of the top guide plate 24 of the second toner cartridge T2 is pressed inward of the toner storing portion 9*a* by the pusher projection 44*d* of the cover member 44. As a result, the first toner cartridge T1 is pushed inward with its top guide plate 24 being flatly in contact with the bottom guide plate 25 of the second toner cartridge T2.

After the first toner cartridge T1 is released from its engaged state as it was in the first embodiment, it is moved further inward of the toner storing portion 9*a*. During this movement, the bottom guide 25 of the first toner cartridge T1 can pass by the rib 46 provided on the lateral walls of the toner storing portion 9*a* without interfering with each other because the bottom guide plate 25 is provided with the cutaway portion 25*b*. Then, the projection 48 provided on the side plate 26 of the toner cartridge T1 comes in contact with the rib 46.

As the projection 48 provided on the side plate 26 is pressed in the inward direction of the toner cartridge T1, the side plate 26 is folded inward at the hinge 26*a*. During this side plate 26 folding process, the projection 48 is loosely fitted into the hole 26*d* correspondingly drilled in the side plate 26; therefore, the folding of the side plate 26 is not impeded by the projection 48 and the rib 46.

Next, the top guide plate 24 of the first toner cartridge T1 passes by the rib 46, without interfering with each other, which is possible because the top guide plate 24 is provided with the cutaway portion 24*a*. Then, the first toner cartridge T1 is moved further into the toner storing portion 9*a*.

Next, toner is refilled into the process cartridge B by pulling out the tear tape 28 of the second toner cartridge T2 in the same manner as pulling the tear tape of the first toner cartridge T1. Lastly, the lid 15 of the image forming apparatus main assembly A is closed, and the image formation is restarted.

Therefore, each time the refilled toner is completely consumed, a fresh supply of toner can be filled into the process cartridge B just by inserting a new cartridge. The preceding cartridge are sequentially compressed and accumulated by the insertion of the following new toner cartridge. In this embodiment, up to four toner cartridges T1, T2, T3 and T4 can be inserted.

As for the state of accumulation, the shield plate 45 is pushed into the deepest portion of the toner storing portion 9*a*. The first to fourth toner cartridges T1–T4 are folded, forcing their top and bottom guide plates 24 and 25 to be disposed in parallel, and thereby reducing their volume. Also, as the first to fourth toner cartridges T1–T4 are accumulated, the bottom guide plate 25 of the second to fourth toner cartridges T2–T4 is fitted into the space surrounded by the rib 24*c* of the top guide plate 24 of the preceding first, second and third toner cartridges T1, T2 and T3, correspondingly, reducing their collective volume.

As described above, the toner cartridge in this embodiment is foldable to reduce its volume to a minimum, saving space. Therefore, the toner cartridge in this embodiment can increase the number of toner cartridges insertable in the toner storing portion, which in turn increases the amount of refillable toner. In addition, it allows new toner cartridges to be inserted in succession without a need for removing the preceding one. Therefore, it makes the toner refilling operation a simple and easily understandable operation, preventing the scattering of the toner. Further, the sealing member having a proper thickness is bonded to the inward facing surface of the front, rear, and lateral walls of the toner storing portion, making it possible to reliably prevent toner leakage.

Further, this embodiment can offer the same effects as the first embodiment, using a simpler structure than the first embodiment.

Embodiment 3

Next, the third embodiment of the toner cartridge T usable with the process cartridge B in accordance with the present invention will be described. Also in this embodiment, only the portions different from those in the toner cartridge T described in the first embodiment will be described, whereas the same portions are designated by the same reference numerals without descriptions.

Figure 34:
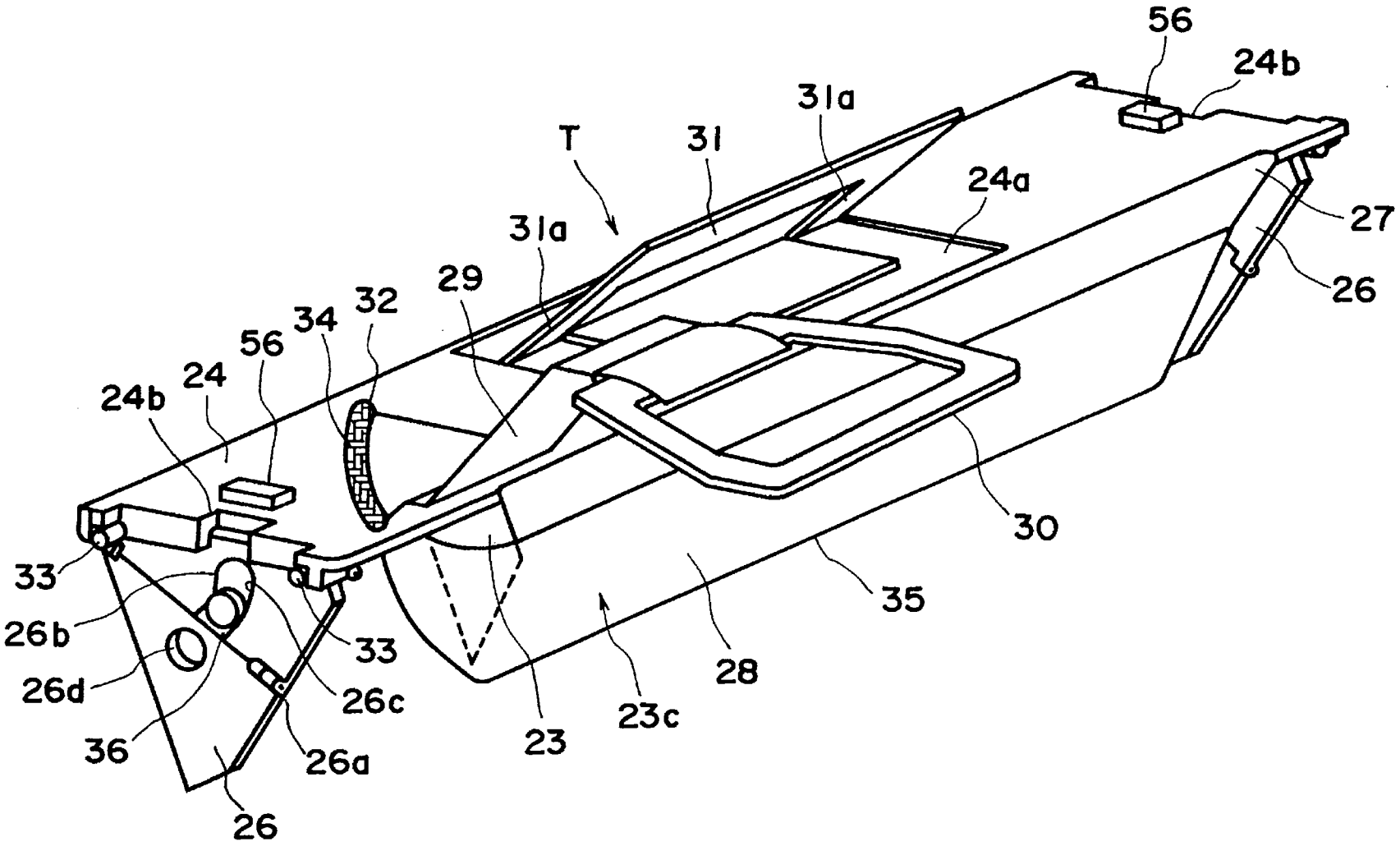
FIG. 34 is a perspective view of the toner cartridge in the third embodiment of the present invention.

Referring to FIG. 34, the toner cartridge T is substantially in the form of a triangular column. Its structure is such that a toner storing container 23 containing toner is surrounded by a top guide plate 24, and two substantially rectangular side plates 26 rotatively connected, one for one, to the longitudinal ends of the top guide plate 24, forming collectively a U-shape. In other words, the structure of the toner cartridge T in this embodiment is approximately that of the toner cartridge T in the first embodiment minus the bottom guide plate 25. Further, a stopper 56 is provided on the top surface of the top guide plate 24, adjacent to the cutaway portion 246. Similarly, the shield plate 45 is also provided with a stopper 58.

Next, an operation for refilling toner into the process cartridge B in accordance with the present invention from the toner cartridge T in accordance with the present invention will be described.

The operations of the process cartridge B and the toner cartridge T during a toner refilling process are substantially the same as those in the first embodiment, except for a minor difference. That is, since the toner cartridge T of this embodiment does not have the bottom guide plate 25, the shield plate 45 is directly pushed at each longitudinal end by the side plate 26 of the toner cartridge T. This will be described next.

Figure 35:
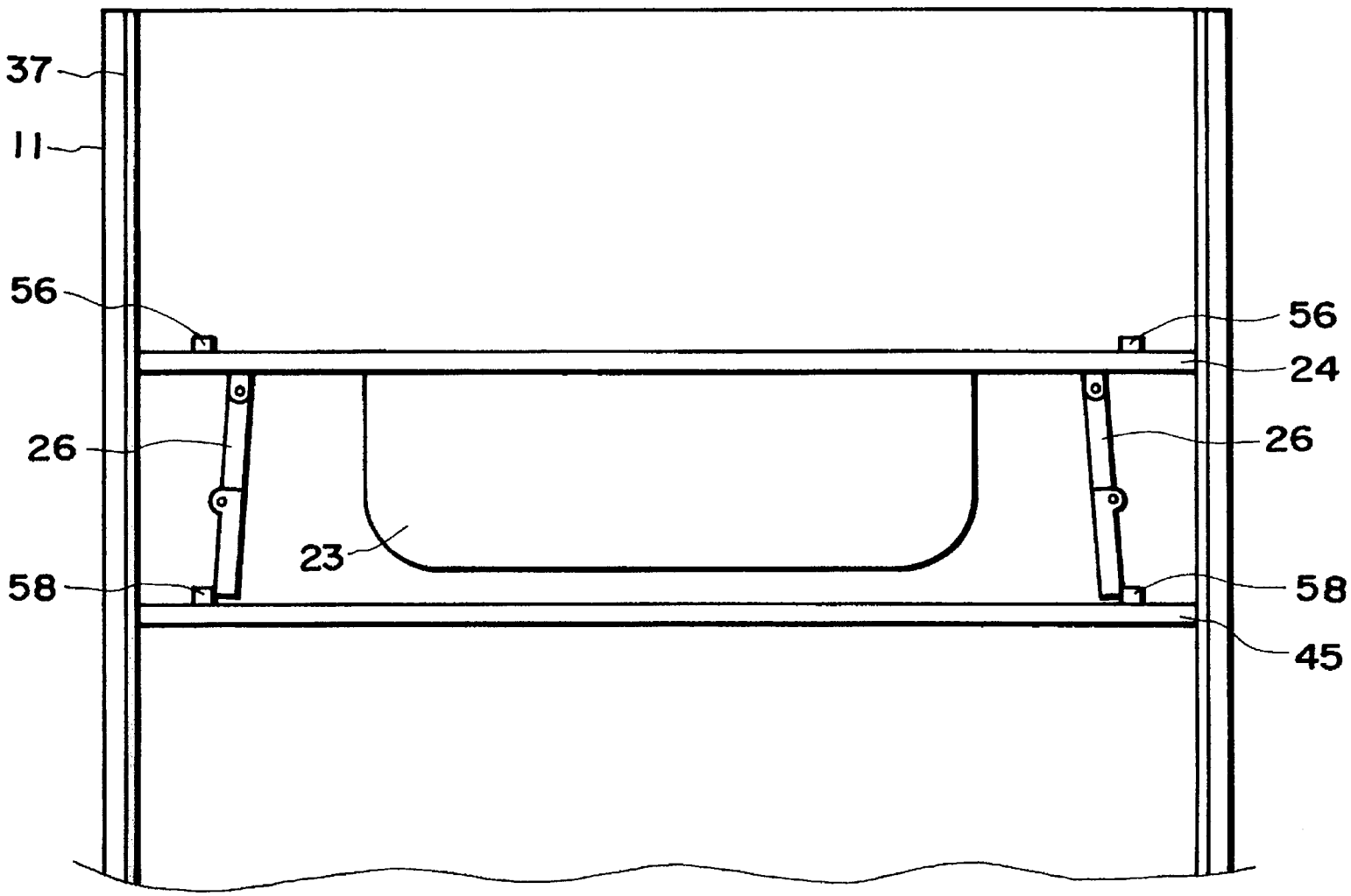
FIG. 35 is an explanatory drawing depicting a state in which the toner cartridge illustrated in FIG. 34 is in the process cartridge.

Referring to FIG. 35, the side plate 26 of the toner cartridge T, is rotatively hinged to the top guide plate 24 by the top edge, and the surface of the bottom end of the side plate 26 is slanted so as to cause the bottom portion to move outward upon receiving pressure in the direction of the plane of the side plate 26.

As the toner cartridge T with the above structure is pushed into the toner storing portion 9*a*, and the side plate 26 directly presses the shield plate 45 at each end, the bottom end of the side plate 26 moves outward, and stops where it collides with the stopper 58. In this state, the side plate 26 can resist the force working to fold the side plate 26 inward; therefore, the toner cartridge T is moved, together with the shield plate 45, inward of the toner storing portion 9*a*, without collapsing.

Further, functions such as disengaging the shield plate 45 or maintaining the sealed state of the toner storing portion 9*a* which had to be carried out by the bottom guide plate 25 during the insertion of the toner cartridge T in the preceding embodiment are taken over by the top guide plate 24. Therefore, the lack of the bottom guide plate 25 does not cause any problem.

Thereafter, toner is discharged into the process cartridge B by pulling out the tear tape 28, with the cover member 44 of the process cartridge B closed, making it possible to restart the image formation, in the same manner as in the first embodiment.

Next, a case in which the toner refilled by the first toner cartridge T1 has been completely consumed, and toner is refilled using the second toner cartridge T2 having the same structure as the first toner cartridge T1 will be described.

Also in this case, toner can be refilled substantially in the same manner as in the first embodiment, except for a minor difference. That is, since there is no bottom guide plate in this embodiment, the side plate 26 of the second toner cartridge T2 directly presses the top guide plate 24 of the first toner cartridge T1 at each longitudinal end. As the side plate 26 of the second toner cartridge T2 directly presses the top guide plate 24 of the first toner cartridge T1, the side plate 26 of the second toner cartridge T2 also is moved outward, and stops where it collides with the stopper 56 provided on the top guide plate 24 of the first toner cartridge T1, in the same manner as it did the side plate 26 of the first toner cartridge T1. In this state, the side plate 26, of the second toner cartridge T2 can resist the force working to fold inward the side plate 26; therefore, the toner cartridge T2 does not collapse.

Thereafter, each time the refilled toner is completely consumed, a fresh supply of toner can be refilled by inserting a new toner cartridge. The old cartridges are sequentially compressed and accumulated by the insertion of a new cartridge.

Also in this embodiment, the same effects as those described in the first and second embodiments can be obtained using the simpler structure.

In the preceding embodiments, the present invention was described with reference to the cases in which the toner cartridge in accordance with the present invention was inserted into a process cartridge. However, it is obvious that the toner cartridge in accordance with the present invention is usable with the toner hopper portion of an image forming apparatus such as an electrophotographic copying machine. It is usable with an apparatus which does not comprise process units such as development roller, and simply stores toner and supplies it to the developing unit.

As is evident from the above description, according to the present invention, it is possible to provide a refill toner container easily collapsible after the completion of a toner refilling operation, and a process cartridge capable of accommodating such a refill toner container.

Further, according to the present invention, it is possible to provide a refill toner container, the seal of which is removable with the process cartridge closed and a process cartridge capable of accommodating such a refill toner cartridge.

Further, according to the present invention, it is possible to provide a refill toner container from which toner can be reliably filled into a toner storing container through a simple toner refilling operation, and a process cartridge capable of accommodating such a refill toner container.

While the invention has been described with reference to the structures disclosed herein, it is not confined to the details set forth and this application is intended to cover such modifications or changes as may come within the purposes of the improvements or the scope of the following claims.

What is claimed is:

1. A toner accommodation container for containing toner to be used for developing a latent image formed on a electrophotographic photosensitive member, wherein said toner accommodation container is supplied with toner from a toner supply container comprising:

a toner accommodating portion for accommodating the toner;

a toner supply opening for supplying toner;

a cover member for covering said toner supply opening, wherein said cover member is movable between a closing position for covering said toner supply opening and an open position for permitting supply of the toner therethrough;

a blocking member, provided inside said covering member, for preventing the toner from scattering from said toner accommodating portion to outside, said blocking member is locked by a first locking member and a second locking member;

wherein said blocking member is movable to said open position by said first locking member being released by said toner supply container and said second locking member being released by said cover member.

2. A container according to claim 1, wherein said toner supply container is mounted to said toner supply opening above said blocking member after said cover is opened, and said cover member is closed as as to push said toner supply container into said toner accommodating portion, and at this time, said first locking member released by said toner supply container, and said second locking member is released by said covering member, so that said blocking member is pushed by said toner supply container to move to the open position, and after said blocking member moves to the open position, a member of said toner supply container prevents the toner from outwardly scattering from said toner accommodating portion.

3. A container according to claim 1, wherein said first locking member comprises a claw provided on a side wall of said toner accommodating portion, said claw is pushed by said cover, and wherein said claw rotates about a shaft to release said blocking member from said claw.

4. A container according to claim 1, wherein said second locking member comprises a claw provided on a rear wall of said toner accommodating portion, said claw is pushed by a guiding member for said toner supply container, and wherein said claw rotates about a shaft to release said blocking member from said claw.

5. A container according to claim 1, wherein said toner supply container comprises a first guiding member for guiding one long side of said toner accommodating portion and a second guiding member for guiding the other long side thereof, wherein said guiding member is the first guiding member, and is disposed at a leading position when said toner supply container is inserted into said toner accommodating portion.

6. A container according to claim 5, wherein said blocking member is in the form of a plate, which, when not locked, urged by said toner supply container which is being inserted into said toner accommodation container to supply the toner into said toner accommodation container, so that it is pushed into said toner accommodation container, wherein said second guiding member prevents outward scattering of the toner.

7. A container according to claim 1, wherein said toner accommodation container is contained in a main assembly of an electrophotographic image forming apparatus.

8. A container according to claim 1, wherein said toner accommodation container is contained in a process cartridge detachably mountable to an electrophotographic image forming apparatus, and wherein said process cartridge contains a electrophotographic photosensitive member and process means actable on said photosensitive member.

9. A process cartridge detachably mountable to a main assembly of an image forming apparatus comprising:

a electrophotographic photosensitive member;

process means actable on said photosensitive member;

a toner accommodation container for containing toner to be used for developing a latent image formed on said electrophotographic photosensitive member, said toner accommodation container including:

a toner accommodating portion for accommodating the toner;

a toner supply opening for supplying toner;

a cover member for covering said toner supply opening, wherein said cover member is movable between a closing position for covering said toner supply opening and an open position for permitting supply of the toner therethrough;

a blocking member, provided inside said covering member, for preventing the toner from scattering from said toner accommodating portion to outside, said blocking member is locked by a first locking member and a second locking member;

wherein said blocking member is movable to said open position by said first locking member being released by said toner supply container and said second locking member being released by said cover member.

10. A process cartridge according to claim 9, wherein said toner supply container is mounted to said toner supply opening above said blocking member after said cover is opened, and said cover member is closed as as to push said toner supply container into said toner accommodating portion, and at this time, said first locking member released by said toner supply container, and said second locking member is released by said covering member, so that said blocking member is pushed by said toner supply container to move to the open position, and after said blocking member moves to the open position, a member of said toner supply container prevents the toner from outwardly scattering from said toner accommodating portion.

11. A process cartridge according to claim 9, wherein said first locking member comprises a claw provided on a side wall of said toner accommodating portion, said claw is pushed by said cover, and wherein said claw rotates about a shaft to release said blocking member from said claw.

12. A process cartridge according to claim 9, wherein said second locking member comprises a claw provided on a rear wall of said toner accommodating portion, said claw is pushed by a guiding member for said toner supply container, and wherein said claw rotates about a shaft to release said blocking member from said claw.

13. A process cartridge according to claim 12, wherein said toner supply container comprises a first guiding member for guiding one long side of said toner accommodating portion and a second guiding member for guiding the other long side thereof, wherein said guiding member is the first guiding member, and is disposed at a leading position when said toner supply container is inserted into said toner accommodating portion.

14. A process cartridge according to claim 9 or 12, wherein said blocking member is in the form of a plate, which, when not locked, urged by said toner supply container which is being inserted into said toner accommodation container to supply the toner into said toner accommodation container, so that it is pushed into said toner accommodation container, wherein said second guiding member prevents outward scattering of the toner.

15. A process cartridge according to claim 9, wherein said process means comprises charging means, developing means, cleaning means, which are formed into a cartridge together with said photosensitive member, and said process cartridge is detachably mountable to the image forming apparatus.

16. A process cartridge according to claim 9, wherein said process means comprises developing means which is formed into a cartridge together with said photosensitive member, and said process cartridge is detachably mountable to the image forming apparatus.

17. An electrophotographic image forming apparatus, for forming an image on a recording material, to which a process cartridge is detachably mountable comprising:.

means for mounting a process cartridge which includes:

a electrophotographic photosensitive member;

process means actable on said photosensitive member;

a toner accommodation container for containing toner to be used for developing a latent image formed on said electrophotographic photosensitive member, said toner accommodation container including:

a toner accommodating portion for accommodating the toner;

a toner supply opening for supplying toner;

a cover member for covering said toner supply opening, wherein said cover member is movable between a closing position for covering said toner supply opening and an open position for permitting supply of the toner therethrough;

a blocking member, provided inside said covering member, for preventing the toner from scattering from said toner accommodating portion to outside, said blocking member is locked by a first locking member and a second locking member;

wherein said blocking member is movable to said open position by said first locking member being released by said toner supply container and said second locking member being released by said cover member.

18. A toner accommodation container for containing toner to be used for developing a latent image formed on said electrophotographic photosensitive member, said toner accommodation container comprising:

a toner accommodating portion for accommodating the toner;

a toner supply opening for supplying toner;

a cover member for covering said toner supply opening, wherein said cover member is rotatable between a closing position for covering said toner supply opening and an open position for permitting supply of the toner therethrough;

a blocking member, provided inside said covering member, for preventing the toner from scattering from said toner accommodating portion to outside, said blocking member is locked by a first locking member and a second locking member, wherein said toner accommodating portion is provided with a sealing member for cooperation with said blocking member to prevent outward scattering of toner;

wherein said toner supply container is mounted to said toner supply opening above said blocking member after said cover is opened, and said cover member is closed so as to push said toner supply container into said toner accommodating portion, and at this time, said first locking member released by said toner supply container, and said second locking member is released by said covering member, so that said blocking member is pushed by said toner supply container to move to the open position, and after said blocking member moves to the open position, a member of said toner supply container prevents the toner from outwardly scattering from said toner accommodating portion.

19. An apparatus according to claim 18, wherein said first locking member comprises a claw provided on a side wall of said toner accommodating portion, said claw is pushed by said cover, and wherein said claw rotates about a shaft to release said blocking member from said claw.

20. An apparatus according to claim 18, wherein said second locking member comprises a claw provided on a rear wall of said toner accommodating portion, said claw is pushed by a guiding member for said toner supply container, and wherein said claw rotates about a shaft to release said blocking member from said claw.

21. An apparatus according to claim 20, wherein said toner supply container comprises a first guiding member for guiding one long side of said toner accommodating portion and a second guiding member for guiding the other long side thereof, wherein said guiding member is the first guiding member, and is disposed at a leading position when said toner supply container is inserted into said toner accommodating portion.

22. An apparatus according to claim 21, wherein said blocking member is in the form of a plate, which, when not locked, urged by said toner supply container which is being inserted into said toner accommodation container to supply the toner into said toner accommodation container, so that it is pushed into said toner accommodation container, wherein said second guiding member prevents outward scattering of the toner.

23. An apparatus according to claim 18, wherein said toner accommodation container is contained in a main assembly of an electrophotographic image forming apparatus.

24. An apparatus according to claim 18, wherein said toner accommodation container is contained in a process cartridge detachably mountable to an electrophotographic image forming apparatus, and wherein said process cartridge contains a electrophotographic photosensitive member and process means actable on said photosensitive member.

25. A process cartridge detachably mountable to a main assembly of an image forming apparatus comprising:

a electrophotographic photosensitive member;

a charging member, contacted to said photosensitive member, for charging it;

a developing member for supplying toner to said photosensitive member to develop a latent image formed on said photosensitive member;

cleaning member, contacted to said photosensitive member, for removing residual toner from said photosensitive member;

a toner accommodation container for containing the toner to be used for developing the latent image formed on said electrophotographic photosensitive member, said toner accommodation container including:

a toner accommodating portion for accommodating the toner;

a toner supply opening for supplying toner;

a cover member for covering said toner supply opening, wherein said cover member is rotatable between a closing position for covering said toner supply opening and an open position for permitting supply of the toner therethrough;

a blocking member, provided inside said covering member, for preventing the toner from scattering from said toner accommodating portion to outside, said blocking member is locked by a first locking member and a second locking member, wherein said toner accommodating portion is provided with a sealing member for cooperation with said blocking member to prevent outward scattering of toner;

wherein said toner supply container is mounted to said toner supply opening above said blocking member after said cover is opened, and said cover member is closed so as to push said toner supply Container into said toner accommodating portion, and at this time, said first locking member released by said toner supply container, and said second locking member is released by said covering member, so that said blocking member is pushed by said toner supply container to move to the open position, and after said blocking member moves to the open position, a member of said toner supply container prevents the toner from outwardly scattering from said toner accommodating portion.

26. A process cartridge according to claim 25, wherein said first locking member comprises a claw provided on a side wall of said toner accommodating portion, said claw is pushed by said cover, and wherein said claw rotates about a shaft to release said blocking member from said claw.

27. A process cartridge according to claim 25, wherein said second locking member comprises a claw provided on a rear wall of said toner accommodating portion, said claw is pushed by a guiding member for said toner supply container, and wherein said claw rotates about a shaft to release said blocking member from said claw.

28. A process cartridge according to claim 27, wherein said toner supply container comprises a first guiding member for guiding one long side of said toner accommodating portion and a second guiding member for guiding the other long side thereof, wherein said guiding member is the first guiding member, and is disposed at a leading position when said toner supply container is inserted into said toner accommodating portion.

29. A process cartridge according to claim 25 or 27, wherein said blocking member is in the form of a plate, which, when not locked, urged by said toner supply container which is being inserted into said toner accommodation container to supply the toner into said toner accommodation container, so that it is pushed into said toner accommodation container, wherein said second guiding member prevents outward scattering of the toner.

30. An electrophotographic image forming apparatus, for forming an image on a recording material, to which a process cartridge is detachably mountable comprising:

means for mounting a process cartridge which includes:

a electrophotographic photosensitive member;

a charging member, contacted to said photosensitive member, for charging it;

a developing member for supplying toner to said photosensitive member to develop a latent image formed on said photosensitive member;

cleaning member, contacted to said photosensitive member, for removing residual toner from said photosensitive member;

a toner accommodation container for containing the toner to be used for developing the latent image formed on said electrophotographic photosensitive member, said toner accommodation container including:

a toner accommodating portion for accommodating the toner;

a toner supply opening for supplying toner;

a cover member for covering said toner supply opening, wherein said cover member is rotatable between a closing position for covering said toner supply opening and an open position for permitting supply of the toner therethrough;

a blocking member, provided inside said covering member, for preventing the toner from scattering from said toner accommodating portion to outside, said blocking member is locked by a first locking member and a second locking member, wherein said toner accommodating portion is provided with a sealing member for cooperation with said blocking member to prevent outward scattering of toner;

wherein said toner supply container is mounted to said toner supply opening above said blocking member after said cover is opened, and said cover member is closed as as to push said toner supply container into said toner accommodating portion, and at this time, said first locking member released by said toner supply container, and said second locking member is released by said covering member, so that said blocking member is pushed by said toner supply container to move to the open position, and after said blocking member moves to the open position, a member of said toner supply container prevents the toner from outwardly scattering from said toner accommodating portion;

said apparatus comprising:

means for feeding the recording material.

* * * * *

UNITED STATES PATENT AND TRADEMARK OFFICE

CERTIFICATE OF CORRECTION

PATENT NO. : 5,655,181

DATED : Aug. 5, 1997

INVENTOR(S) : CHADANI ET AL.

It is certified that error appears in the above-identified patent and that said Letters Patent is hereby corrected as shown below:

Column 1

Line 64, "provided" should read --provide--.

Column 2

Line 31, "portion" should read --position--; and
Line 56, "portion" should read --position--.

Column 5

Line 43, "10" should read --10a--.

Column 6

Line 67, "Cover" should read --cover--.

Column 7

Line 1, "rotated." should read --rotated--.

Column 8

Line 21, "rear" should read --tear--;
Line 29, "This" should read --That--; and
Line 41, "that" should read --that the--.

Column 12

Line 36, "Guide" should read --guide--.

UNITED STATES PATENT AND TRADEMARK OFFICE

CERTIFICATE OF CORRECTION

PATENT NO. : 5,655,181

DATED : Aug. 5, 1997

INVENTOR(S) : CHADANI ET AL.

It is certified that error appears in the above-identified patent and that said Letters Patent is hereby corrected as shown below:

Column 13

Line 24, "44" should read --44d--;
Line 48, "arc-shaped;" should read --arc-shaped.--;
Line 49, "therefore," should read --Therefore,--; and
Line 53, "from" should read --from being--.

Column 15

Line 63, "to the" should read --to--.

Column 16

Line 44, "On" should read --on--.

Column 18

Line 53, "246" should read --24b--.

Column 20

Line 45, "as as" should read --so as--.

Column 21

Line 53, "as as" should read --so as--.

UNITED STATES PATENT AND TRADEMARK OFFICE

CERTIFICATE OF CORRECTION

PATENT NO. : 5,655,181

DATED : Aug. 5, 1997

INVENTOR(S) : CHADANI ET AL.

It is certified that error appears in the above-identified patent and that said Letters Patent is hereby corrected as shown below:

Column 23

Line 19, "released" should read --being released--; and
Line 20, "is" should read --being--.

Column 24

Line 33, "Container" should read --container--; and
Line 35, "released" should read --being released--; and
Line 36, "is" should read --being--.

Column 26

Line 12, "as as" should read --so as--; and
Line 15, "released" should read --being released; and
Line 15, "is" should read --being--.

Signed and Sealed this

Twenty-first Day of April, 1998

Bruce Lehman

*Attest:*

BRUCE LEHMAN

*Attesting Officer*

*Commissioner of Patents and Trademarks*